US011312529B2

(12) United States Patent
Zacherle et al.

(10) Patent No.: US 11,312,529 B2
(45) Date of Patent: Apr. 26, 2022

(54) ARTICLE CARRIER AND BLANK THEREFOR

(71) Applicant: WestRock Packaging Systems, LLC, Atlanta, GA (US)

(72) Inventors: Matthew E. Zacherle, Chesterfield, VA (US); Andrew T. Peeler, Richmond, VA (US)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 96 days.

(21) Appl. No.: 16/365,314

(22) Filed: Mar. 26, 2019

(65) Prior Publication Data

US 2019/0300231 A1 Oct. 3, 2019

Related U.S. Application Data

(60) Provisional application No. 62/650,621, filed on Mar. 30, 2018.

(51) Int. Cl.
*B65D 5/462* (2006.01)
*B65D 5/48* (2006.01)
(Continued)

(52) U.S. Cl.
CPC ..... *B65D 5/48014* (2013.01); *B65D 5/0227* (2013.01); *B65D 5/3614* (2013.01);
(Continued)

(58) Field of Classification Search
CPC ..... B65D 5/48014; B65D 5/0227; B65D 5/3614; B65D 5/4266; B65D 5/4279;
(Continued)

(56) References Cited

U.S. PATENT DOCUMENTS 2,687,232 A * 8/1954 Arneson ..... B65D 71/0022 206/188
3,400,856 A * 9/1968 Arneson ..... B65D 71/0022 206/184
(Continued)

FOREIGN PATENT DOCUMENTS

EP 1365970 B1 8/2006

*Primary Examiner* — Luan K Bui
(74) *Attorney, Agent, or Firm* — Neil G. Cohen; Brian J. Goldberg

(57) ABSTRACT

Aspects of the disclosure relate to an article carrier for packaging a plurality of flanged articles, a blank for forming the article carrier. The article carrier comprises a plurality of primary panels for forming a tubular structure and defining an interior thereof. The plurality of primary panels includes a first panel and a second panel opposing the first panel. The article carrier further comprises a partition structure for dividing the interior into two or more article-receiving cells. The partition structure is formed from the first panel and comprises a lateral partition panel. The lateral partition panel is hingedly connected at a proximal end to the first panel by a proximal end fold line and is hingedly connected at a distal end to a glue panel by a distal end joint. The distal end joint between the lateral partition panel and the glue panel comprises a twistable strip extending between and joined with the lateral partition panel and the glue panel.

23 Claims, 12 Drawing Sheets

(51) Int. Cl.

| | |
|---|---|
| ***B65D 5/02*** | (2006.01) |
| ***B65D 71/58*** | (2006.01) |
| ***B65D 5/36*** | (2006.01) |
| ***B65D 5/42*** | (2006.01) |
| ***B65D 5/468*** | (2006.01) |

(52) U.S. Cl.
CPC ..... *B65D 5/4266* (2013.01); *B65D 5/4279* (2013.01); *B65D 5/4608* (2013.01); *B65D 71/0022* (2013.01); *B65D 2313/10* (2013.01); *B65D 2571/0037* (2013.01)

(58) Field of Classification Search
CPC ..... B65D 5/4608; B65D 71/0022; B65D 2313/10; B65D 2571/0037
USPC ..... 206/186–188, 191, 193, 198

See application file for complete search history.

(56) References Cited

U.S. PATENT DOCUMENTS

| | | | | | |
|---|---|---|---|---|---|
| 3,814,238 | A | | 6/1974 | Wood | |
| 4,308,950 | A | * | 1/1982 | Wood | B65D 71/0022 206/188 |
| 4,319,682 | A | * | 3/1982 | Wright | B65D 71/0022 206/180 |
| 4,374,561 | A | * | 2/1983 | Stout | B65D 71/0022 206/188 |
| 4,413,729 | A | | 11/1983 | Wood | |
| 4,450,956 | A | | 5/1984 | Wood | |
| 4,465,181 | A | | 8/1984 | Wood | |
| 4,493,415 | A | | 1/1985 | Wood | |
| 4,782,944 | A | * | 11/1988 | Engdahl, Jr. | B65D 71/0022 206/170 |
| 5,682,985 | A | | 11/1997 | Plaxico et al. | |
| 6,168,013 | B1 | * | 1/2001 | Gomes | B65D 71/0022 206/162 |
| 7,455,175 | B2 | * | 11/2008 | Cuomo | B65D 71/0022 206/175 |
| 9,061,810 | B2 | | 6/2015 | Brand | |

* cited by examiner

ARTICLE CARRIER AND BLANK THEREFOR

TECHNICAL FIELD

The present invention relates to carriers and to blanks for forming the same. More specifically, but not exclusively, the invention relates to a carrier having a partition structure feature defining cells or compartments within and interior of a carrier of the basket-style.

BACKGROUND

In the field of packaging it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present invention to provide to a carrier having a partition structure for separating articles within an interior chamber of the carrier. It is desirable to minimise or reduce the material required to produce the carrier for economic or environmental benefit or both.

The present invention seeks to provide an improvement in the field of cartons, typically formed from paperboard or the like.

SUMMARY

A first aspect of the invention provides an article carrier for packaging a plurality of articles. The article carrier comprises a plurality of primary panels for forming a tubular structure and defining an interior of the article carrier. The plurality of primary panels includes a first panel and a second panel opposing the first panel. The article carrier may comprise a partition structure for dividing the interior into two or more article-receiving cells. The partition structure is formed from the first panel and comprises a lateral partition panel. The lateral partition panel is hingedly connected at a proximal end to the first panel by a proximal end fold line. The lateral partition panel is hingedly connected at a distal end to a glue panel by a distal end joint. The distal end joint between the lateral partition panel and the glue panel may comprise a twistable strip extending between and joined with the lateral partition panel and the glue panel. The lateral partition panel has a length defined by a first distance extending between the proximal end fold line of the lateral partition panel and a distal end edge of the lateral partition panel. The first distance may be generally equal to or less than a second distance extending between the first panel and the second panel.

Optionally, the partition structure comprises a pair of lateral partition panels each hingedly connected at their respective proximal ends to the first panel by proximal end fold lines and at their respective distal ends to a common glue panel by distal end joints, wherein the distal end joint between a first one of the pair of lateral partition panels and the glue panel comprises the twistable strip.

Optionally, the tubular structure is collapsible.

Optionally, the partition structure is automatically erected when the tubular structure is erected from a collapsed condition.

Optionally, the tubular structure comprises an end closed at least in part by one or more bottom panels.

A second aspect of the invention provides an article carrier comprising a plurality of primary panels for defining an interior of the article carrier. The plurality of primary panels includes a first panel and an opposing second panel for forming a part of a tubular structure which may be collapsible. The tubular structure has an end closed at least in part by one or more bottom panels. The article carrier may comprise a partition structure for dividing the interior into two or more article-receiving cells. The partition structure may be formed from the first panel. The partition structure comprises first and second lateral partition panels. Each of the first and second lateral partition panels may be hingedly connected at their respective proximal ends to the first panel by proximal end fold lines. Each of the first and second lateral partition panels may be hingedly connected at their respective distal ends to a common glue panel by distal end joints. The distal end joint between the first lateral partition panel and the glue panel may comprise a twistable strip extending between and joined with the first lateral partition panel and the glue panel. The first lateral partition panel has a length defined by a first distance, the first distance is defined between the proximal end fold line of the first lateral partition panel and a distal end edge of the first lateral partition panel. The first distance may be generally equal to or less than a second distance, the second distance extending between the first panel and the second panel.

Optionally, the twistable strip is a single joint which connects between the distal end of the first lateral partition panel and the glue panel.

Optionally, the glue panel includes a glue-free region along an end edge thereof and continuous with the distal end edge of the first lateral partition panel, the glue-free region extends along the distal end edge into the first lateral partition panel.

Optionally, the twistable strip is defined at least in part by a tear stopper or element disposed in at least one of the first lateral partition panel and the glue panel.

Optionally, the twistable strip is defined, at least in part, by a cutaway element provided in at least one of the first lateral partition panel and the glue panel.

Optionally, the twistable strip is defined, at least in part, by a curved element extending in at least one of the first lateral partition panel and the glue panel. The curved element has at least one terminal end which is spaced apart from an adjacent one of the end edge and the distal end edge. A third distance defined between the at least one terminal end and the adjacent one of the end edge and the distal end edge is equal to or greater than a fourth distance, the fourth distance extending from the adjacent one of the end edge and the distal end edge to another part of the curved element.

Optionally, the twistable strip is defined, at least in part, by a curved element extending in at least one of the first lateral partition panel and the glue panel. The curved element has at least one terminal end which may be directed away from the adjacent one of the end edge and the distal end edge.

Optionally, the first lateral partition panel and the glue panel are separated from each other along a cut line when the carrier is in a blank form. The cut line extends between the proximal end fold line and the curved element. The curved element comprises one selected from the group consisting of a C-shaped cut, a J-shaped cut, an oval slot and an aperture.

Optionally, the twistable strip is defined at least in part by a curved element extending into both the first lateral partition panel and the glue panel.

Optionally, the glue panel includes a glue-free region disposed along an end edge thereof. The end edge is continuous with the distal end edge of the first lateral partition panel. The glue-free region extends into the first lateral partition panel along the distal end edge. The first lateral partition panel and the glue panel may be separated from each other along or by a cut line or frangible line. The glue-free region may include at least an area defined between the end edge and the distal end edge and a notional line passing through the cut line. The notional line may extend alongside the end edge and the distal end edge.

Optionally, the glue-free region includes at least an area defined between an edge of the partition structure including the end edge and the distal end edge and a notional line passing through the at least one terminal end of the cutaway element or curved element. The notional line may extend alongside said edge of the partition structure.

Optionally, the twistable strip has a maximum width extending between the at least one terminal end and the adjacent one of the end edge and the distal end edge.

Optionally, the twistable strip is disposed at an elevation vertically offset from the distal end fold line.

Optionally, the elevation of the twistable strip is below the lower end of the distal end fold line or above the upper end of the distal end fold line.

Optionally, the first lateral partition panel comprises a proximal portion connected to, or integral with, the first panel, an intermediate portion joined to, or integral with, the proximal portion and a distal portion joined to, or integral with, the intermediate portion and wherein the proximal and distal portions are disposed at their respective elevations vertically offset from each other.

Optionally, the glue panel includes a glue-free region along an end edge thereof and continuous with the distal end edge of the first lateral partition panel. The glue-free region extends along the distal end edge into the first lateral partition panel. The twistable strip is defined at least in part by a cutaway element provided in the glue-free region of at least one of the first lateral partition panel and the glue panel.

Optionally, the cutaway element comprises one selected from the group consisting of a linear cutline, a non-linear cutline, a frangible line, a slit, a slot, a C-shaped cut, a J-shaped cut, an oval slot and an aperture.

A third aspect of the invention provides an article carrier of the basket carrier style. The article carrier comprises a plurality of primary panels for forming a tubular structure and defining interior of the article carrier. The plurality of primary panels includes a first side panel and a second side panel opposing the first side panel. The article carrier further comprises at least one medial panel dividing the interior into a pair of compartments. A first partition structure may divide a first one of the pair of compartments into two or more article-receiving cells. The partition structure may be formed from the at least one medial panel. The partition structure comprises at least one lateral partition panel. A first lateral partition panel may be hingedly connected at a proximal end to the at least one medial panel by a proximal end fold line. The first lateral partition panel may be hingedly connected at a distal end to a glue panel by a distal end joint. The glue panel may be secured to the first side panel. The distal end joint between the first lateral partition panel and the glue panel may comprise a twistable strip extending between and joined with the first lateral partition panel and the glue panel. The first lateral partition panel has a length defined by a first distance extending between the proximal end fold line of the first lateral partition panel and a distal end edge of the first lateral partition panel. The first distance may be generally equal to or less than a second distance, the second distance extends between the at least one medial panel and the first side panel.

Optionally, the medial panel comprises a carrying handle.

Optionally, the article carrier further comprises a second partition structure for dividing a second one of the pair of compartments into two or more article-receiving cells, the second partition structure being formed from the at least one medial panel and comprising at least one second lateral partition panel. A second lateral partition panel is hingedly connected at a proximal end to the at least one medial panel by a proximal end fold line and is hingedly connected at a distal end to a second glue panel by a distal end joint, the second glue panel is secured to the second side panel.

Optionally, the distal end joint between the second lateral partition panel and the second glue panel comprises a twistable strip extending between and joined with the second lateral partition panel and the second glue panel, wherein the second lateral partition panel has a length defined by a first distance extending between the proximal end fold line of the second lateral partition panel and a distal end edge of the second lateral partition panel and wherein the first distance is generally equal to or less than a second distance extending between the at least one medial panel and the second side panel.

A fourth aspect of the invention provides a blank for forming an article carrier, the blank comprising a plurality of primary panels for forming walls of a tubular structure defining an interior chamber, the plurality of primary panels including:

a first panel; and a second panel opposing the first panel;

wherein the blank further comprises a partition structure for dividing the interior chamber into two or more article-receiving cells, the partition structure being formed from the first panel and comprising a lateral partition panel hingedly connected at a proximal end to the first panel by a proximal end fold line and hingedly connected at a distal end to a glue panel by a distal end joint;

wherein the distal end joint between the lateral partition panel and the glue panel comprises a twistable strip extending between and joined with the lateral partition panel and the glue panel;

wherein the lateral partition panel has a length defined by a first distance extending between the proximal end fold line of the lateral partition panel and a distal end edge of the lateral partition panel; and wherein the first distance is arranged to be generally equal to or less than a second distance extending between the first panel and the second panel when the blank is erected to form a tubular structure.

A fifth aspect of the invention provides a blank for forming an article carrier. The blank comprises a plurality of primary panels for forming walls of a tubular structure defining an interior chamber. The plurality of primary panels includes a first panel and an opposing second panel for forming a part of a collapsible tubular structure. The blank comprises one or more bottom panels for closing an end of the tubular structure. The blank further comprises a partition structure formed from the first panel for dividing the interior chamber into two or more article-receiving cells. The partition structure comprises first and second lateral partition panels hingedly connected at their respective proximal ends to the first panel by proximal end fold lines and at their respective distal ends to a common glue panel by distal end joints. The distal end joint between the first lateral partition panel and the glue panel comprises a twistable strip extending between and joined with the first lateral partition panel and the glue panel. The first lateral partition panel has a length defined by a first distance, the first distance defined between the proximal end fold line of the first lateral partition panel and a distal end edge of the first lateral partition panel. The first distance is generally equal to or less than a second distance. The second distance is defined between the first panel and the second panel when the blank is erected to form a tubular structure.

A sixth aspect of the invention provides a blank for forming an article carrier of the basket carrier style. the blank comprising a plurality of primary panels for forming walls of a tubular structure defining an interior chamber, the plurality of primary panels including:

a first side panel; and a second side panel opposing the first side panel.

The blank further comprises:

at least one medial panel for dividing the interior chamber into a pair of compartments, the at least one medial panel is hingedly connected to one of the plurality of primary panels; and a first partition structure for dividing a first one of the pair of compartments into two or more article-receiving cells, the partition structure is formed from the at least one medial panel and comprises a lateral partition panel hingedly connected at a proximal end to the at least one medial panel by a proximal end fold line and hingedly connected at a distal end to a glue panel by a distal end joint. The glue panel is secured to the first side panel.

The distal end joint between the lateral partition panel and the glue panel comprises a twistable strip extending between and joined with the lateral partition panel and the glue panel.

The lateral partition panel has a length defined by a first distance extending between the proximal end fold line of the lateral partition panel and a distal end edge of the lateral partition panel.

The first distance is generally equal to or less than a second distance, the second distance is defined between the at least one medial panel and the first side panel when the blank is erected to form a tubular structure.

Further features and advantages of the present invention will be apparent from the specific embodiments illustrated in the drawings and discussed below.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
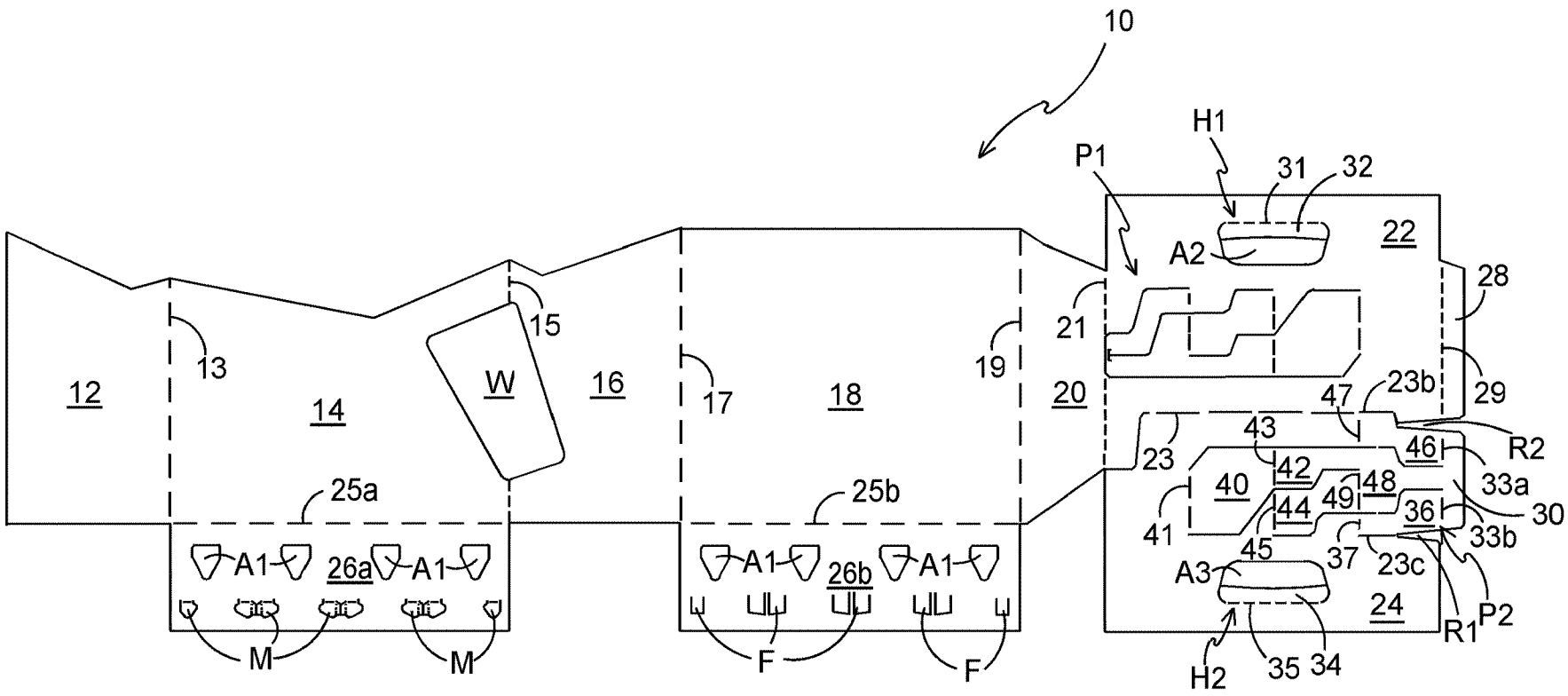
FIG. 1 is a plan view from above of a blank for forming a carrier according to a first embodiment.
Figure 2:
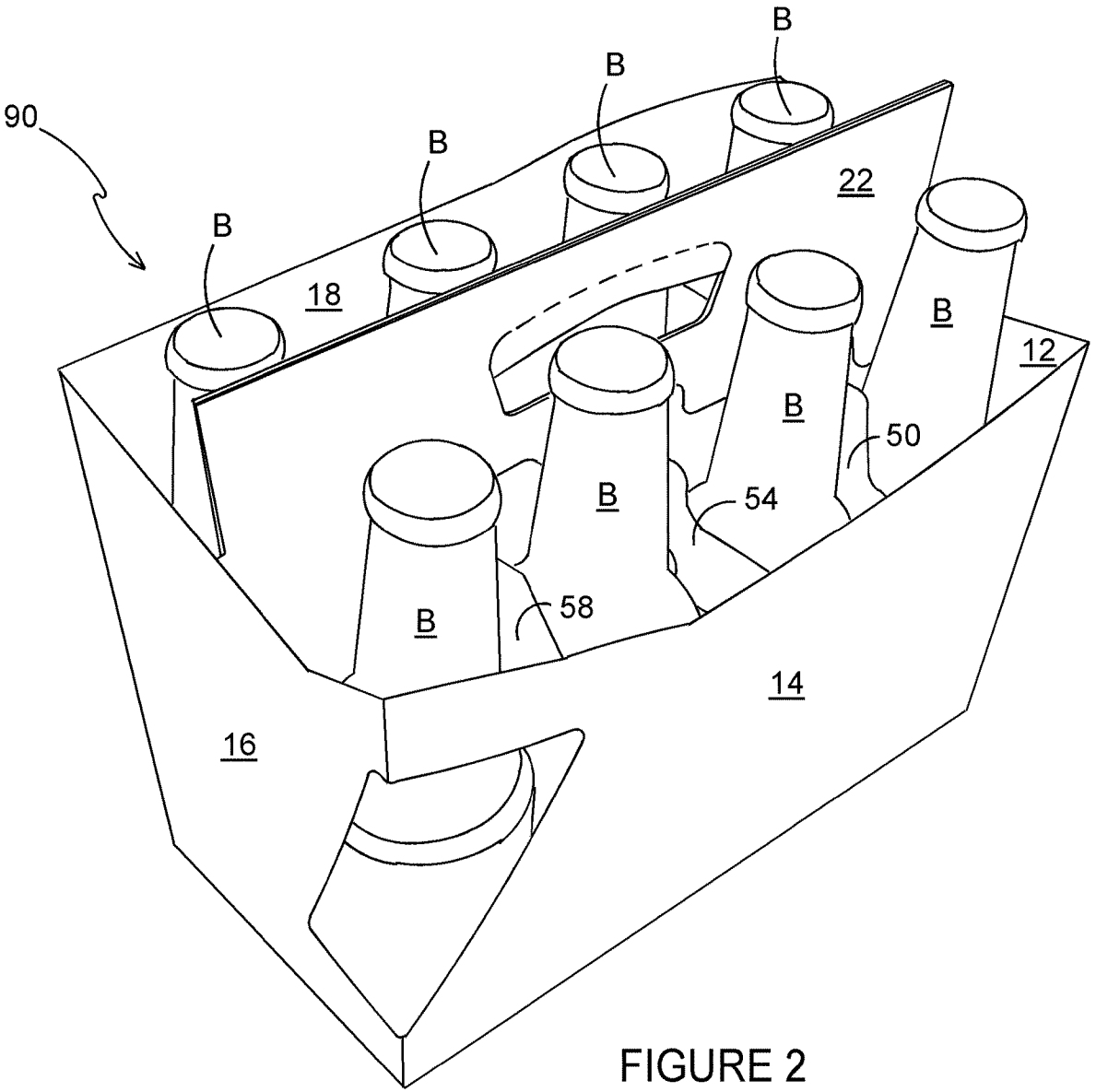
FIG. 2 is a perspective view from above of a carton formed from the blank of FIG. 1.

Referring to FIG. 1, there is shown a plan view of a blank 10 capable of forming a carton or carrier 90, as shown in FIG. 2, for containing and carrying a group of primary products such as, but not limited to, bottles, hereinafter referred to as articles B. FIGS. 8 to 13, illustrate alternative blanks 110; 210; 310; 410; 510; 610; 710; 810 capable of forming a carton or carrier (not shown), for containing and carrying a group of primary products such as, but not limited to, bottles, hereinafter referred to as articles B. The blanks 10; 110; 210; 310; 410; 510; 610; 710; 810 each form a secondary package of the basket-carrier style for packaging at least one primary product container or package.

In the embodiments detailed herein, the terms "carton" and "carrier" refer, for the non-limiting purpose of illustrating the various features of the invention, to a container 90 for engaging and carrying articles B, such as primary product containers B. It is contemplated that the teachings of the invention can be applied to various product containers B, which may or may not be tapered and/or cylindrical. Other exemplary containers include bottles (for example metallic, glass or plastics bottles), cans (for example aluminium cans), tins, pouches, packets and the like.

The blanks 10; 110; 210; 310; 410; 510; 610; 710; 810 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structure or carton 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiment, the blanks 10; 110; 210; 310; 410; 510; 610; 710; 810 are configured to form a carton or carrier 90 for packaging an exemplary arrangement of exemplary articles B. In the illustrated embodiments the arrangement is an m×n matrix or array, having two rows (m=2) and four columns (n=4); in the illustrated embodiment two rows of four articles B are provided, and the articles B are 16 fl. oz. (473 ml) bottles, the bottle may be formed from a suitable material such as, but not limited to, glass, Aluminium or PET (polyester-polyethylene terephthalate). Alternatively, the blanks 10; 110; 210; 310; 410; 510; 610; 710; 810 can be configured to form a carrier for packaging other types, number and size of articles B and/or for packaging articles B in a different arrangement or configuration for example, but not limited to, fully enclosed cartons or wrap-around carriers, the articles B may be cups, pouches, pots or cans.

Turning to FIG. 1, there is illustrated a blank 10 for forming a carton 90 (see FIG. 2) according to a first embodiment. The blank 10 comprises a plurality of main panels 12, 14, 16, 18, 20 for forming a tubular structure. The plurality of main panels 12, 14, 16, 18, 20 comprises a first outer end panel 12 (or outer layer), a first side panel 14, a second end panel 16, a second side panel 18, and a first inner end panel or securing panel (or inner layer) 20. The plurality of panels 12, 14, 16, 18, 20 may be arranged in a linear series hinged one to the next by corresponding fold lines 13, 15, 17, 19.

The blank 10 comprises a first base panel 26*a* hinged to the first side panel 14 by a hinged connection in the form of a fold line 25*a*. The blank 10 comprises a second base panel 26*b* hinged to the second side panel 18 by a hinged connection in the form of a fold line 25*b*.

The first and second base panels 26*a*, 26*b* are engageable with one another in an overlapping relationship to form a composite base wall 26*a*/26*b* of the carrier 90. The blank 10 may comprise a complementary locking mechanism for securing the first base panel 26*a* to the second base panel 26*b*. The first base panel 26*a* may comprise at least one first part M of the complementary locking mechanism. The second base panel 26*b* may comprise at least one second part F of the complementary locking mechanism. In the illustrated embodiment, the first base panel 26*a* comprises five male tabs M struck therefrom so as to be defined within the first base panel 26*a*. Each of the male tabs M is hingedly connected to the first base panel 26*a* by a hinged connection in the form of a fold line.

The second part F of the complementary locking mechanism forms a receiver. The receiver comprises an opening or slot for receiving the male tab M.

The second base panel 26*b* comprises five optional female tabs each defining an opening or slot in the second base panel 26*b*; the female tabs forming at least part of the receiver.

The openings in the second base panel 26*b* are configured to receive respective ones of the male tabs M.

The female tabs are arranged to be displaced out of the second base panel 26*b* to form said openings and to bear against the respective male tab M when received therein. In some embodiments the complementary locking mechanism M/F may be omitted, the first and second base panels 26*a*, 26*b* may be secured to each other by other means, such as but not limited to adhesive or staples.

Optionally, the first and second base panels 26*a*, 26*b* may comprise at least one first aperture A1. In the illustrated embodiment, each of the first and second base panels 26*a*, 26*b* comprises four first apertures A1. The first apertures A1 may be employed to facilitate construction of the carton 90. A packaging machine component or tool may engage with the first apertures A1 to facilitate alignment of the first and second base panels 26*a*, 26*b* with respect to each other or to align the first part M of the complementary locking mechanism with the second part F of the complementary locking mechanism. The complementary locking mechanism illustrated and described is entirely optional.

The blank 10 optionally comprises a display window aperture W struck in part from the first side panel 14 and in part from the second end panel 16. In a set up carrier the display window aperture W exposes to view a portion of an article B disposed adjacent thereto. The display window is provided about a corner of the tubular structure formed from the plurality of main panels 12, 14, 16, 18, 20. The display window exposes to view a portion of an article B disposed at one end of a first one of the rows of articles B.

The blank 10 comprises a medial structure including a first medial panel 22 and a second medial panel 24.

The first medial panel 22 is hingedly connected at a first end to the first inner end panel 20 by a hinged connection in the form of a fold line 21.

The second medial panel 24 is hingedly connected to the first medial panel 22 along a lower edge thereof by a hinged connection in the form of a fold line 23.

The first and second medial panels 22, 24 form a divider extending longitudinally between the first inner and outer end panels 12, 20 and the second end panel 16.

The first medial panel 22 provides a first handle structure H1. The second medial panel 24 provides a second handle structure H2. Together the first and second medial panels 22, 24 provide a two ply handle structure, the second ply reinforcing the first ply.

The first handle structure H1 comprises a first handle opening.

The first handle opening may be defined in part by a first handle aperture A2 struck from an upper portion of the first medial panel 22.

The first handle structure H1 may comprise an optional first cushioning flap 32 struck from the first medial panel 22 and hinged thereto by a hinged connection in the form of a fold line 31. The first cushioning flap 32 defines at least a part of the first handle opening.

The second handle structure H2 comprises a second handle opening.

The second handle opening may be defined in part by a second handle aperture A3 struck from, or defined within, an upper portion of the second medial panel 24.

The second handle structure H2 may comprise an optional second cushioning flap 34 struck from the second medial panel 24 and hinged thereto by a hinged connection in the form of a fold line 35. The second cushioning flap 34 defines at least a part of the second handle opening.

The second handle opening is arranged to be disposed in registry or alignment with the first handle opening.

The blank 10 comprises medial partition glue flap 28 hingedly connected to the first medial panel 22 along a second end (the second end opposes the first end, the first end is defined by fold line 21) by a hinged connection in the form of a fold line 29.

Figure 1A:
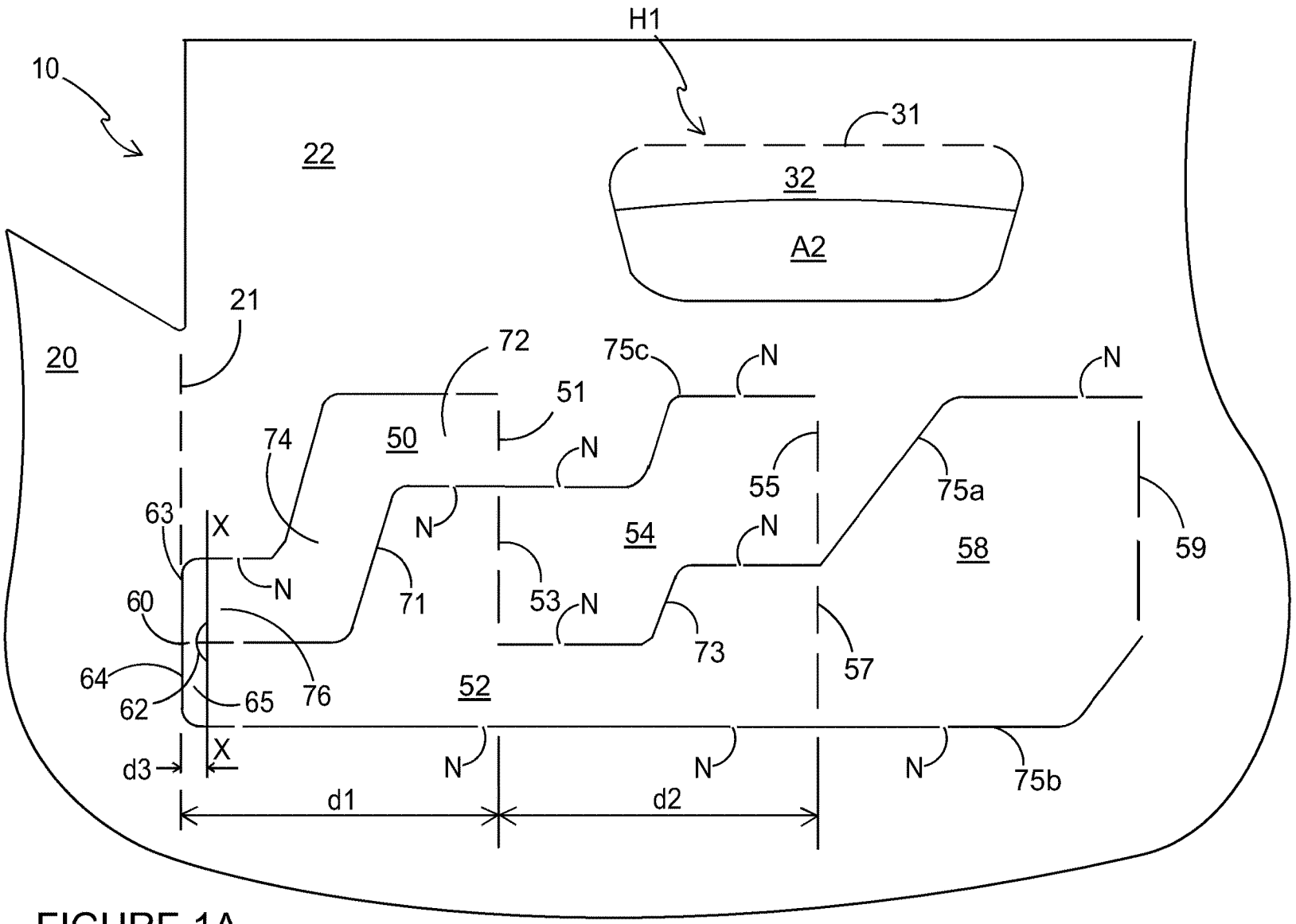
FIG. 1A is an enlarged view of a portion of the blank of FIG. 1.

The blank 10 comprises a first partition structure P1 best illustrated in FIG. 1A. The first partition structure P1 defines or creates a plurality of cells disposed between the first side panel 14 and the first medial panel 22. The first side panel 14 and the first medial panel 22 along with portions of the first and second end panels 12, 16 define a tubular structure or first compartment on a first side of the medial structure.

The first compartment provides an interior for receiving at least a lower portion of one or more articles B.

The first partition structure P1 comprises a first partition panel 50 struck from the first medial panel 22 and hingedly connected, at a first or proximal end, thereto by a hinged connection in the form of a fold line 51.

The first partition structure P1 comprises a second partition panel 54 struck from the first medial panel 22 and hingedly connected, at first or a proximal end, thereto by a hinged connection in the form of a fold line 55.

The first partition structure P1 comprises a third partition panel 58 struck from the first medial panel 22 and hingedly connected thereto by a hinged connection in the form of a fold line 59.

The first, second and third partition panels 50, 54, 58 are dimensioned to extend between the first medial panel 22 and the first side panel 14 in a set up condition.

The first partition structure P1 comprises a first glue panel 52 to which the first, second and third partition panels 50, 54, 58 are each coupled by distal end joints.

The third partition panel 58 is hingedly connected, at a second or distal end, to a first end of the first glue panel 52 by a hinged connection in the form of fold line 57. Fold line 57 defines an outer end of the third partition panel 58, fold line 59 defines an inner end of the third partition panel 58 a linear dimension is defined therebetween.

Fold line 57 is collinear with fold line 55 in the blank 10.

The second partition panel 54 is hingedly connected, at a second or distal end, to an intermediate portion of the first glue panel 52 by a hinged connection in the form of fold line 53. Fold line 53 defines an outer end of the second partition panel 54, fold line 55 defines an inner end of the second partition panel 54, and a linear dimension, denoted by dimension arrow d2 in FIG. 1A, is defined therebetween.

Fold line 53 is collinear with fold line 51 in the blank 10.

The first partition panel 50 is separated from the first glue panel 52 along or by a cut line or severance line 71. The first partition panel 50 may be severably coupled to the first glue panel 52 by one or more connecting portions or nicks N which interrupt the cut line or severance line 71.

The second partition panel 54 is separated from the first glue panel 52 by a cut line or severance line 73. The second partition panel 54 may be severably coupled to the first glue panel 52 by one or more connecting portions or nicks N which interrupt the cut line or severance line 73.

The first partition panel 50, third partition panel 58 and first glue panel 52 are defined in part by a cut line or severance line 75*b*. The first partition panel 50, third partition panel 58 and first glue panel 52 are separated from the first medial panel 22 by the cut line or severance line 75*b*. The first partition panel 50, third partition panel 58 and first glue panel 52 may be severably coupled to the first medial panel 22 by one or more connecting portions or nicks N which interrupt the cut line or severance line 75*b*.

The second partition panel 54 is separated from the first medial panel 22 by a cut line or severance line 75*c*. The second partition panel 54 may be severably coupled to the first medial panel 22 by one or more connecting portions or nicks N which interrupt the cut line or severance line 75*c*.

The third partition panel 58 is separated from the first medial panel 22 by a further cut line or severance line 75*a*. The third partition panel 58 may be severably coupled to the first medial panel 22 by one or more connecting portions or nicks N which interrupt the cut line or severance line 75*a*.

The first partition panel 50 is coupled, at a second or distal end, to the first glue panel 52 by a twistable strip 60, formed in part from a distal end portion of the first partition panel 50 and in part from a second end portion of the first glue panel 52. The twistable strip 60 extends between, and joins with, the first partition panel 50 and the first glue panel 52.

The first partition panel 50 has a length defined by a first distance, denoted by dimension arrow d1 in FIG. 1A, the first distance d1 is defined by a linear dimension extending between a proximal end fold line 51 of the first partition panel 50 and a distal end edge 63 of the first partition panel 50. The first distance d1 is generally equal to or less than a second distance between the first medial panel 22 and the first side wall panel 14 in a setup carrier 90.

The distal end portion of the first partition panel 50 is disposed in vertical alignment with the second end portion of the first glue panel 52.

The twistable strip 60 may form a single joint which connects between the distal end of the first partition panel 50 and the first glue panel 52.

The first glue panel 52 may comprise a glue-free region 65 along an end edge 64 thereof. The end edge 64 of the first glue panel 52 is continuous with the distal end edge 63 of the first partition panel 50. The glue-free region 65 extends along the distal end edge 63 into the first partition panel 50.

The glue-free region 65 extends continuously into the first partition panel 50.

The twistable strip 60 is defined at least in part by a tear stopper or element 62 disposed in at least one of the first partition panel 50 and the first glue panel 52.

The element 62 may take the form of a cutaway, extending in at least one of the first partition panel 50 and the first glue panel 52. The element 62 may be a cutline. The element 62 may be a nonlinear cutline or may be comprised of two or more divergently arranged linear cut lines. The element 62 may be arcuate or curvilinear. In other embodiments the element 62 may be an aperture, slot, slit, oval slot or frangible line. In the embodiment illustrated in FIG. 1A the element 62 is a curved element and extends into both the first partition panel 50 and the first glue panel 52. The curved element 62 comprises at least one terminal end which is spaced apart from an adjacent end edge of the twistable strip 60 provided by the end edge 64 of the first glue panel 52 or by the distal end edge 63 of the first partition panel 50 or by both the end edge 64 of the first glue panel 52 and the distal end edge 63 of the first partition panel 50.

The distal end edge 63 of the first partition panel 50 and the end edge 64 of the first glue panel 52 are arranged to be continuous and define an end edge of the first partition structure P1.

The at least one terminal end and the adjacent end edge 63, 64 of the twistable strip 60 define a second distance d3. The second distance d3 is defined by a linear dimension extending between the at least one terminal end and the end edge 63, 64 of the twistable strip 60.

The second distance d3 may be equal to or greater than the distance between the end edge 63, 64 of the twistable strip 60 and another part of the curved element 62.

The curved element 62 may be arranged such that at least one terminal end is directed away from the end edge 64 of the first glue panel 52 or from the distal end edge 63 of the first partition panel 50 or from both the end edge 64 of the first glue panel 52 and the distal end edge 63 of the first partition panel 50.

The cut line 71 separating the first partition panel 50 from the first glue panel 52 extends between the proximal end fold line 51 and the curved element 62. The curved element 62 may be formed from a C-shaped cut as illustrated in FIG. 1. In other embodiments the curved element 62 may be formed from a J-shaped cut, an oval slot or an aperture.

The glue-free region 65 includes at least an area defined between the end edge 63, 64 of the twistable strip 60 and a notional line X-X. The notional line X-X passes through the cut line 71 separating the first partition panel 50 from the first glue panel 52.

The notional line X-X may be spaced apart from the vertex or intersection between the cut line 71 and the curved element 62. The notional line X-X may be inset from said vertex or intersection.

The notional line X-X may be oriented perpendicular to the cut line 71.

The notional line X-X extends alongside the end edge 63, 64 of the first partition structure P1.

The notional line X-X may be oriented in parallel with the end edge 63, 64 of the twistable strip 60.

The notional line X-X may be oriented in parallel with the fold line 21 between the first medial panel and the first inner end panel 12.

The notional line X-X may pass through the at least one terminal end of the curved element 62. In the embodiment illustrated in FIG. 1A the notional line X-X passes through both terminal ends of the curved element 62. The notional line X-X extends along the end edge 63, 64 of the twistable strip 60.

The twistable strip 60 has a maximum width d3. In the illustrated embodiment, the maximum width d3 is defined between the at least one terminal end and the end edge 63, 64 of the twistable strip 60.

The twistable strip 60 is disposed at an elevation vertically offset from the distal end fold line 51.

In the illustrated embodiment the elevation of the twistable strip 60 is below the lower end of the distal end fold line 51. In other embodiments, the elevation of the twistable strip 60 may be above the upper end of the distal end fold line 51.

The first partition panel 50 comprises a proximal portion 72 connected to, or integral with, the first medial panel 22, an intermediate portion 74 joined to, or integral with, the proximal portion 72 and a distal portion 76 joined to, or integral with, the intermediate portion 74 and wherein the proximal and distal portions 72 76 are disposed at their respective elevations vertically offset from each other.

Optionally, the blank 10 comprises a second partition structure P2. The second partition structure P2 defines a plurality of cells disposed between the second side panel 18 and the second medial panel 24. The second side panel 18 and the second medial panel 24 along with portions of the first and second end panels 12, 16 define a second tubular structure or compartment on a second side of the medial structure.

The second compartment provides an interior chamber for accommodating at least a lower portion of one or more articles B.

The second partition structure P2 comprises a fourth partition panel 40 struck from the second medial panel 24 and hingedly connected, at a first or proximal end, thereto by a hinged connection in the form of a fold line 41.

The second partition structure P2 comprises a fifth partition panel 44 struck from the second medial panel 24 and hingedly connected, at first or a proximal end, thereto by a hinged connection in the form of a fold line 45.

The second partition structure P2 comprises a sixth partition panel 36/46 struck from the second medial panel 24 and hingedly connected thereto by a hinged connection in the form of fold lines 37, 47. The sixth partition panel 36/46 comprises an upper partition panel 36 and a lower partition panel 46. The upper partition panel 36 is hingedly connected, at first or a proximal end, to the second medial panel 24 by fold line 37 and the lower partition panel 46 is hingedly connected, at first or a proximal end, to the second medial panel 24 by fold line 47.

The fourth, fifth and sixth partition panels 40, 44, 36/46 are dimensioned to extend between the second medial panel 24 and the second side panel 18 in a set up condition.

The second partition structure P2 comprises a second glue panel 42/48 to which the fourth and fifth partition panels 40, 44 are each coupled.

The fourth partition panel 40 is hingedly connected, at a second or distal end, to a first end of the glue panel 2 by a hinged connection in the form of fold line 43. Fold line 43 defines an outer end of the fourth partition panel 40, fold line 41 defines an inner end of the fourth partition panel 40.

The fifth partition panel 44 is hingedly connected, at a second or distal end, to an intermediate portion of the second glue panel 42/48 by a hinged connection in the form of fold line 49. Fold line 49 defines an outer end of the fifth partition panel 44, fold line 45 defines an inner end of the fifth partition panel 44.

Fold line 43 is collinear with fold line 45 in the blank 10.

The second glue panel 42/48 comprises a first portion 42 to which the fourth partition panel 40 is hingedly connected and a second portion 48 to which the fifth partition panel 44 is hingedly connected.

The upper partition panel 50 is separated from the lower partition panel 46 by the second glue panel 42/48.

The upper partition panel 50 is separated from the lower partition panel 46 by the second portion 48 of the second glue panel 42/48

The upper partition panel 36 is coupled to the lower partition panel 46 by a glue flap 30. Glue flap 30 is hingedly connected to a second or distal end of the upper partition panel 36 by a hinged connection in the form of fold line 33*b*. Glue flap 30 is hingedly connected to a second or distal end of the lower partition panel 46 by a hinged connection in the form of fold line 33*a*.

The glue flap 30 may be unitary or integral with the second glue panel 42/48. In this way the glue flap 30 is joined to the second glue panel 42/48 in an uninterrupted fashion.

A cutline or severance line defines a lower edge of the fourth partition panel 40 and the second glue panel 42/48; the cutline separates the fourth partition panel 40 and a first portion of the second glue panel 42/48 from the second medial panel 24, the cutline separates a second portion 48 of the second glue panel 42/48 from the lower partition panel 46.

A further cutline or severance line defines an upper edge of the fourth partition panel 40 and the first portion of the second glue panel 42/48; the further cutline separates the fourth partition panel 40 from the second medial panel 24, the further cutline separates the first portion of the second glue panel 42/48 from the fifth partition panel 44.

Another cutline or severance line defines an upper edge of the fifth partition panel 44 and the second portion 48 of the second glue panel 42/48;

The upper partition panel 36 is separated, in part, from the second medial panel 24 by a first cut line or severance line 23*c*.

The upper partition panel 24 is separated, in part, from the second medial panel 24 by a first cutaway R1 in the form of a notch, slot or recess. The first cutaway R1 is struck from an end portion of the blank 10.

The first cutaway R1 is arranged to be contiguous with the first cut line 23*c*.

The lower partition panel 46 is separated, in part, from the first medial panel 22 by a second cut line or severance line 23*b*. At least a portion of the second cut line 23*b* may arranged collinearly with the fold line 23 hinging the first and second medial panels 22, 24 to each other.

The lower partition panel 46 is separated, in part, from the first medial panel 22 by a second cutaway R2 in the form of a notch, slot or recess. The second cutaway R2 is struck from an end portion of the blank 10.

The second cutaway R2 may be offset from the portion of the second cut line 23*b* which is collinear with the fold line 23. The second cutaway R2 is arranged to be contiguous with the second cut line 23*b*.

The blank 10 is foldable to form a package 90 as illustrated in FIG. 2.

Turning to the construction of the carton 90 as illustrated in FIG. 2, the carton 90 can be formed by a series of sequential folding operations in a straight-line machine so that the carton 90 is not required to be rotated or inverted to complete its construction. The folding process is not limited to that described below and may be altered according to particular manufacturing requirements.

Glue or other adhesive treatment is applied to one or both of the first and second medial panels 22, 24.

Figure 4:
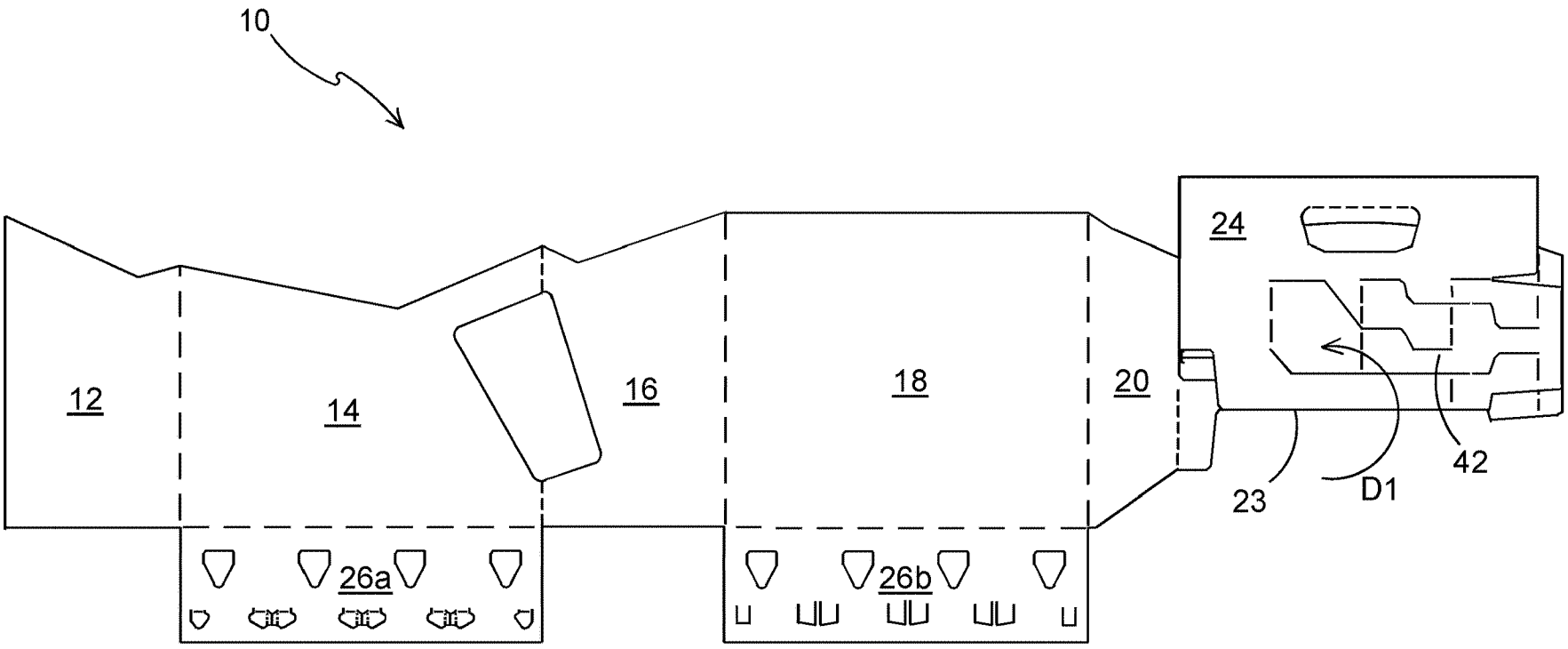
FIGS. 4 to 7 illustrate stages of construction of the blank of FIG. 1 into a flat collapsed carrier.

The second medial panel 24 is folded, with respect to the first medial panel 22 about fold line 23, as indicated by direction arrow D1 shown in FIG. 4. The second medial panel 24 is secured to the first medial panel 22 in face contacting relationship therewith.

Glue or other adhesive treatment is applied to the second glue panel 42/48. Alternatively, glue or other adhesive treatment may be applied to a corresponding region of the second side panel 18.

Figure 5:
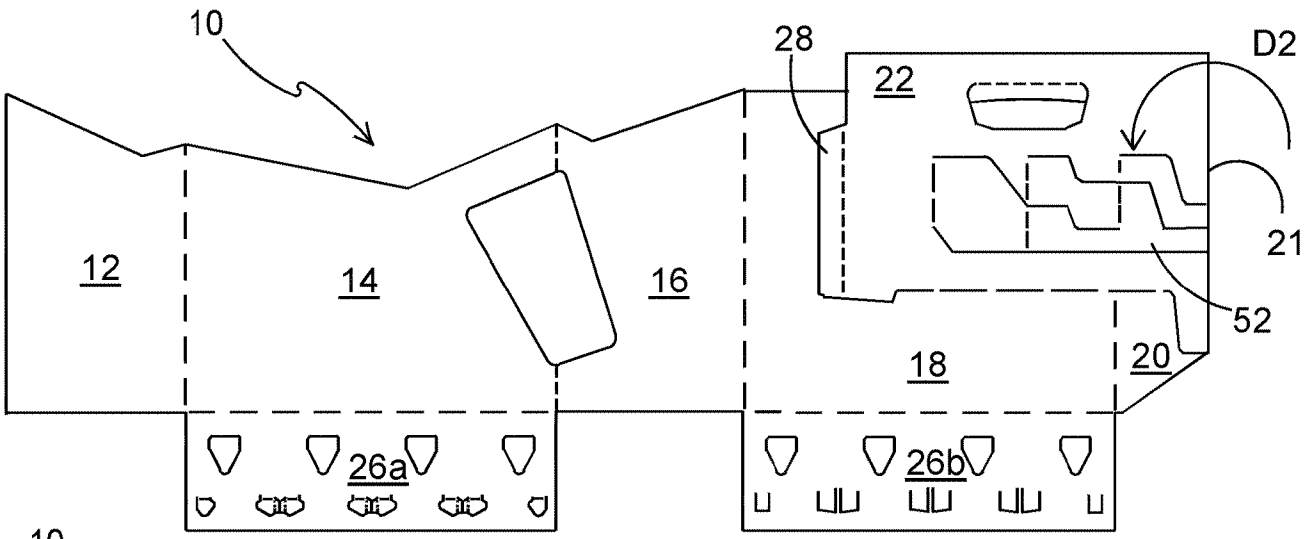

The first medial panel 24 (and consequently the second medial panel 24) is folded, with respect to the first inner end panel 20 about fold line 21, as indicated by direction arrow D2 shown in FIG. 5. The second medial panel 24 is brought into face to face relationship with the second side panel 18 and the first inner end panel 20. The second glue panel 42/48 is secured to the second side panel 18 in face contacting relationship therewith.

Glue or other adhesive treatment is applied to the first glue panel 52. Alternatively, glue or other adhesive treatment may be applied to a corresponding region of the first side panel 14.

Glue or other adhesive treatment is applied to the medial partition glue flap 28. Alternatively, glue or other adhesive treatment may be applied to a corresponding region of the second end panel 16.

Figure 6:
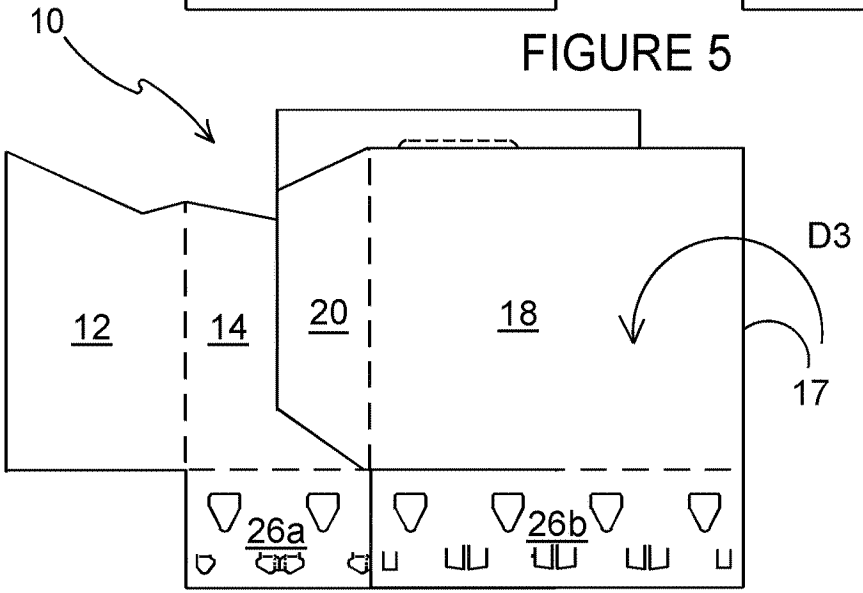

The second side panel 18, together with the first and second medial panel 22, 24, is folded about the fold line 17 to bring the first medial panel 22 into face to face relationship with the second end panel 16 and the first side panel 14, as indicated by direction arrow D3 in FIG. 6.

The medial partition glue flap 28 is secured to the second end panel 16.

The first glue panel 52 is secured to the first side panel 14.

Glue or other adhesive treatment is applied to the first inner end panel 20. Alternatively, glue or other adhesive treatment may be applied to a corresponding region of the first outer end panel 12.

Figure 7:
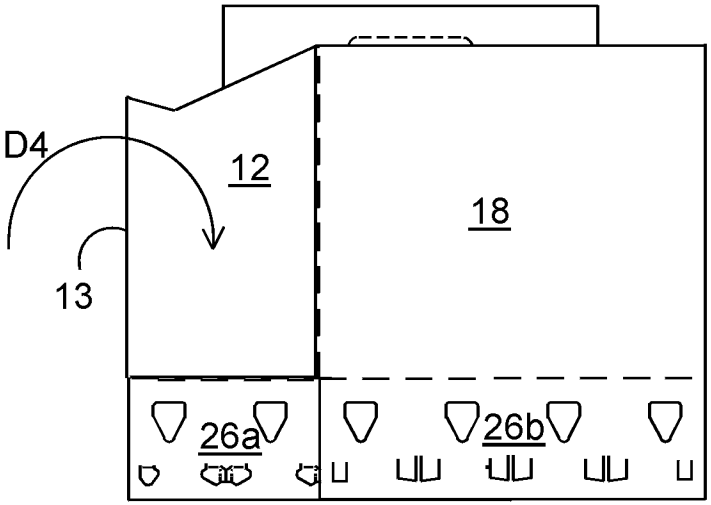

The first outer end panel 12 is folded about the fold line 13 as indicated by direction arrow D4 in FIG. 7 so as to be disposed in face to face relationship with the first inner end panel 20.

The first outer end panel 12 is secured to the first inner end panel 20. In this way a flat collapsed tubular structure is formed.

A flat collapsed carrier is thereby formed, as shown in FIG. 7, the flat collapsed carrier can be readily shipped or distributed in the flat condition to a plant for erecting and loading with primary product containers.

The flat collapsed carrier can be opened into a basket-style article carrier by separating the first and second side panels 14, 18 to form a tubular structure defined by the main panels 12, 14, 16, 18, 20. The main panels 12, 14, 16, 18, 20 define an interior chamber. The partition structures P1, P2 are automatically erected when the flat collapsed carrier is opened out or erected into the tubular form.

Once the carrier 90 is erected, the first and second medial panels 22, 24 form a partition, that is disposed medially within the interior of the carrier 90 formed by the main panels 12, 14, 16, 18, 20. The partition divides the interior of the carrier 90 into two separate compartments on opposing sides of the first and second medial panels 22, 24.

The first partition structure P1 is automatically erected to form a first plurality of cells in a first compartment disposed on a first side of the first and second medial panels 22, 24.

The second partition structure P2 is automatically erected to form a second plurality of cells in a second compartment disposed on a second side of the first and second medial panels 22, 24.

The carrier 90 may be loaded with a group of articles B; in the embodiment illustrated in FIG. 2 eight articles B are arranged in a 4×2 array.

The group of articles B may be loaded through a lower end of the tubular structure formed by the main panels 12, 14, 16, 18, 20 prior to folding the first and second base panel 26*a*, 26*b*. Alternatively, the group of articles B may be loaded through an upper end of the tubular structure subsequent to assembly of the composite base panel 26*a*, 26*b*.

The second base panel 26*b* is folded with respect to the second side panel 18 about fold line 25*b*. The first base panel 26*a* is folded with respect to the first side panel 14 about fold line 25*a*. The first base panel 26*a* is brought into face contacting relationship with the second base panel 26*b*. The first base panel 26*a* is disposed in at least partial overlapping relationship with the second base panel 26*b*.

Each of the first parts M of the complementary locking mechanism is aligned with a respective one of the second parts F of the complementary locking mechanism. The first parts M of the complementary locking mechanism are folded inwardly of the interior of the carrier such that they are received by the second parts F of the complementary locking mechanism, when the second parts F of the complementary locking mechanism comprises female tabs these are also folded inwardly and may bear against the first parts M of the complementary locking mechanism.

Figure 3:
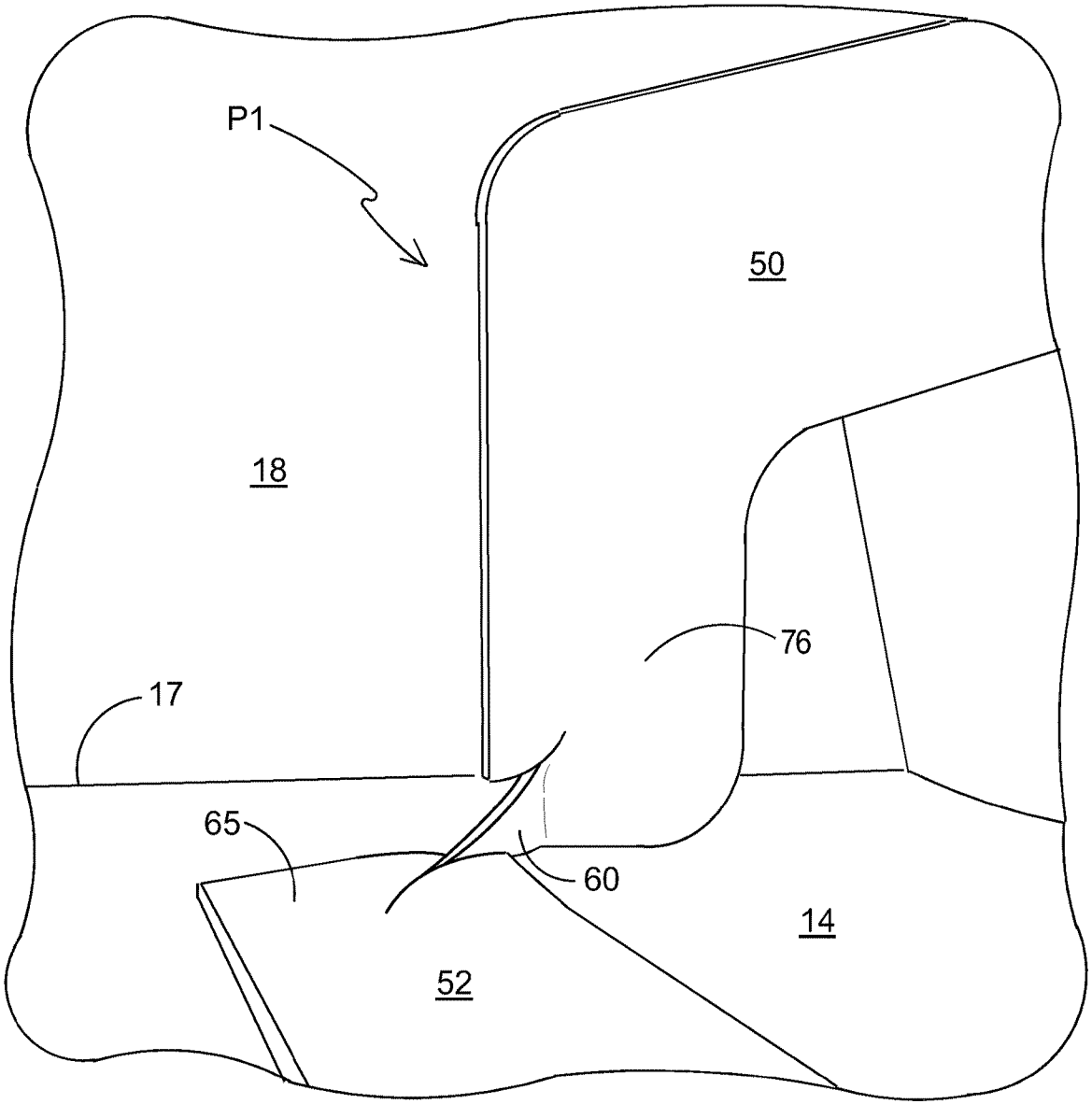
FIG. 3 is a perspective view of an interior portion of a carton formed from the blank of FIG. 1.

FIG. 3 illustrate an internal view of a portion of the first partition structure P1 in the erected condition. The first glue panel 52 is secured in face to face relationship with the first side panel 14. The first partition panel 50 has been displaced out of the plane of the first glue panel 52, the first partition panel 50 may be oriented substantially perpendicular to the first side panel 14. The first partition panel 50 is coupled to the first glue panel 52 by the twistable strip 60, which has been twisted along its length. A first end is connected to the first glue panel 52 and a second opposing end is connected to the first partition panel 50.

Referring now to FIGS. 8 to 13, there are shown alternative embodiments of the present invention. In the second, third, fourth and subsequent illustrated embodiments like numerals have, where possible, been used to denote like parts, albeit with the addition of the prefix "100"; "200"; "300" and so forth to indicate that these features belong to the second, third, fourth and subsequent embodiments respectively. The alternative embodiments share many common features with the first embodiment, and therefore only the differences from the embodiment illustrated in FIGS. 1 to 7 will be described in any greater detail.

Figure 8:
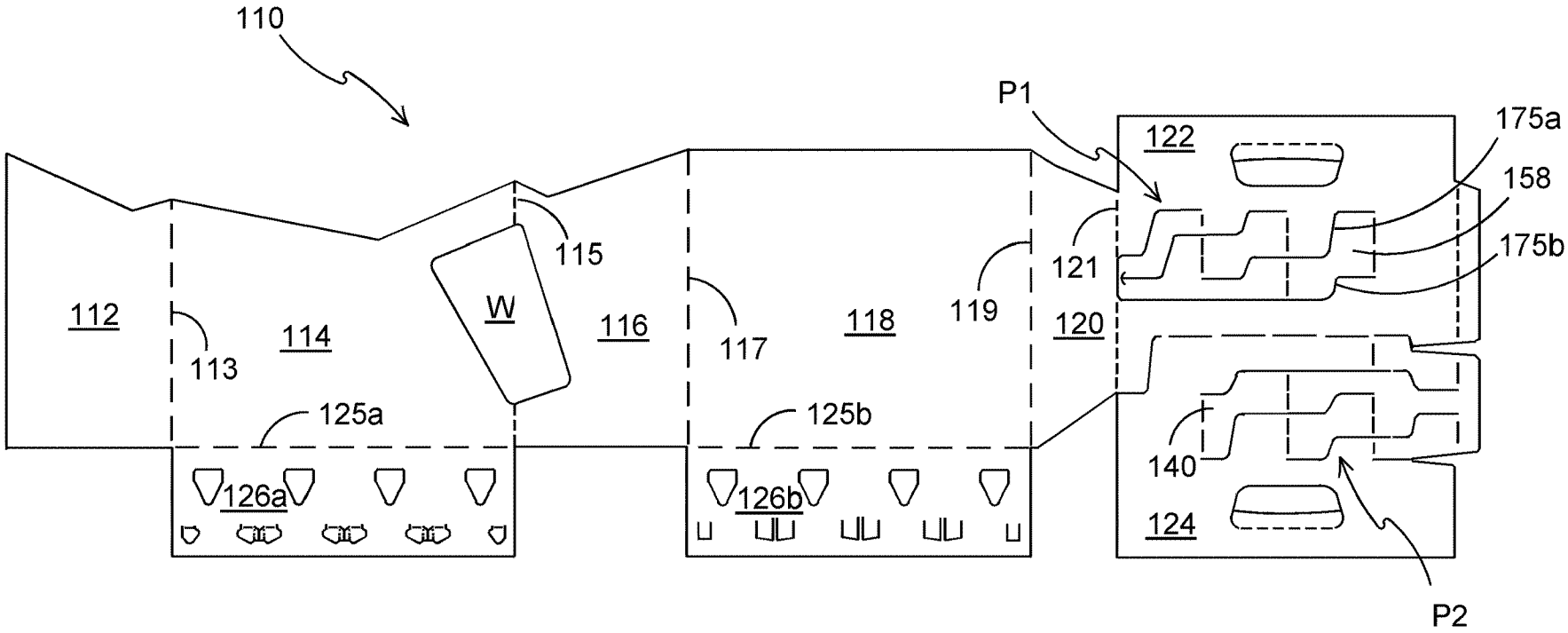
FIG. 8 is a plan view from above of a blank for forming a carrier according to a second embodiment.

In the embodiment of FIG. 8 a second embodiment is illustrated; the shape of a third partition panel 158 and of a fourth partition panel 140 have been altered. In place of the irregular hexagon shape of the embodiment of FIG. 1 the third and fourth partition panels 158, 140 have a substantially stepped configuration (or "S") shape. The cut lines 175*a*, 175*b* each comprise a pair of parallel linear portions vertically offset from each other. A first linear portion is connected to a second, parallel, linear portion by an intermediate portion. The intermediate portion may be substantially vertical. The intermediate portion and the first, lower, portion define an angle therebetween, the angle defined may be between 90° and 120°, optionally between 90° and 110°. Optionally, the angle may be between 90° and 100°.

The intermediate portion of cutline 175*a* may be vertically aligned, at least in part with the intermediate portion of cutline 175*b*.

In the embodiment of FIG. 1A the cutline 75*a* comprises a first portion oriented substantially parallel to fold line 23 and a second portion oriented obliquely thereto. The first portion of the cutline 75*a* and the second portion of the cutline 75*a* and define an angle therebetween, the angle defined may be between 90° and 130°, optionally between 120° and 130°. The cutline 75*b* comprises a first portion oriented substantially parallel to fold line 23 and a second portion oriented obliquely thereto. The first portion of the cutline 75*b* and the second portion of the cutline 75*b* and define an angle therebetween, the angle defined may be between 90° and 130°, optionally between 120° and 130°.

The second portion of the cutline 75*a* and the second portion of the cutline 75*b* are longitudinally offset from each other such that none of the second portion of the cutline 75*a* is disposed vertically above the second portion of the cutline 75*b*. This may be advantageous in preventing, inhibiting or reducing the likelihood of either or both of the third and fourth partition panels 58, 40 to bend or deform.

The second portion of the cutline 75*a* and the second portion of the cutline 75*b* may be vertically offset from each other such that none of the second portion of the cutline 75*a* is disposed at the same elevation as the second portion of the cutline 75*b*.

Intermediate portions of the cut lines defining upper and lower edges of the first partition panel 50, 150 are similarly arranged so as to be longitudinally offset from each other such that none of the intermediate portion of the cutline defining the upper edge of the first partition panel 50, 150 is disposed vertically above the intermediate portion of the cutline defining the lower edge of the first partition panel 50, 150. This may be advantageous in preventing, inhibiting or reducing the likelihood of the first partition panel 50, 150 to bend or deform.

Figure 9:
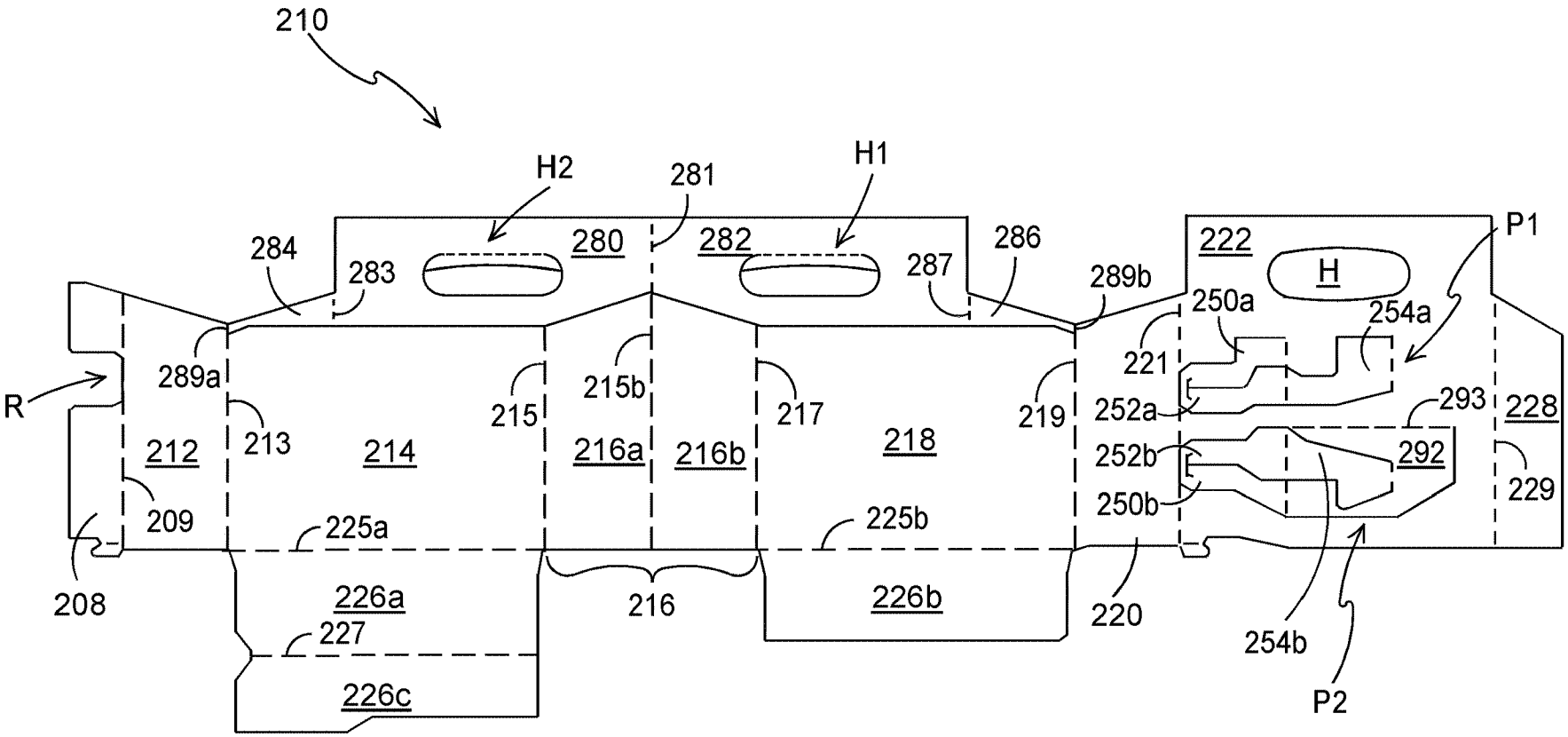
FIG. 9 is a plan view from above of a blank for forming a carrier according to a third embodiment.

Referring now to the embodiment of FIG. 9 there is shown a third illustrated embodiment. The blank 210 comprises a plurality of main panels 208, 212, 214, 216*a*, 216*b*, 218, 220 for forming a tubular structure. The plurality of main panels 208, 212, 214, 216*a*, 216*b*, 218, 220 comprises a riser panel 208, a pair of first end panel portions 212, 220 (for forming a first end panel 212/220), a first side panel 214, a second end panel 216 comprising a pair of second end panel portions 216*a*, 216*b* and a second side panel 218. The plurality of panels 208, 212, 214, 216*a*, 216*b*, 218, 220 may be arranged in a linear series: the riser panel 208; a first one of the pair of the first end panel portions 212; the first side panel 214; a first one of the pair of the second end panel portions 216*a*; a second one of the pair of the second end panel portions 216*b*; the second side panel 218; and a second one of the pair of the first end panel portions 220; hinged one to the next by corresponding fold lines 209, 213, 215, 215*b*, 217, 219.

The blank 210 comprises a first base panel 226*a* hinged to the first side panel 214 by a hinged connection in the form of a fold line 225*a*; a base glue flap 226*c* is hinged to the first base panel 226*a* by a hinged connection in the form of a fold line 227. The blank 10 comprises a second base panel 226*b* hinged to the second side panel 218 by a hinged connection in the form of a fold line 225*b*. The base glue flap 226*c* is arranged to be secured to the second base panel 226*b* such that a composite base panel 226*a*/226*b*/226*c* is formed, the composite base panel 226*a*/226*b*/226*c* is foldable about a medial fold line 227 extending longitudinally thereacross.

The blank 210 comprises a medial structure including a first medial panel 222.

The first medial panel 222 is hingedly connected at a first end to the second one of the pair of the first end panel portions 220 by a hinged connection in the form of a fold line 221.

The first medial panel 222 forms a divider extending longitudinally between the first end panel 212/220 and the second end panel 216.

The first medial panel 222 provides a first handle structure H. The first handle structure H comprises a first handle opening. The first handle opening may be defined a first handle aperture struck from an upper portion of the first medial panel 222.

The first handle structure H1 may comprise an optional first cushioning flap struck from the first medial panel 222 and hinged thereto by a hinged connection in the form of a fold line. The first cushioning flap defines at least a part of the first handle opening.

The blank 210 comprises a first handle reinforcing panel 282. The first handle reinforcing panel 282 is disposed adjacent to the second side panel 218 and to the second one of the pair of the second end panel portions 216*b*. The first handle reinforcing panel 282 is separated from the second side panel 218 and from the second one of the pair of the second end panel portions 216*b* by a cutline. The first handle reinforcing panel 282 is connected to the second one of the pair of the first end panel portions 220 at a first side edge of the first handle reinforcing panel 282 by a first bridging panel 286.

The first bridging panel 286 is disposed adjacent to the second side panel 218. A first side edge of the first bridging panel 286 is coupled to a first side edge of the first handle reinforcing panel 282 by a hinged connection in the form of a fold line 287. A second side edge of the first bridging panel 286 is coupled to a side edge of the second one of the pair of the first end panel portions 220 by a connecting portion 289*b*. The connecting portion 289*b* is sufficient to maintain the connection between the first bridging panel 286 and the second one of the pair of the first end panel portions 220 during handling of the blank 210 prior to assembly and optionally during at least a portion of the assembly process. The first bridging panel 286 is separated from second side panel 218 by a cutline.

The blank 210 comprises a second handle reinforcing panel 280. The second handle reinforcing panel 280 is disposed adjacent to the first side panel 214 and to the first one of the pair of the second end panel portions 216*a*. The second handle reinforcing panel 280 is separated from the first side panel 214 and from the first one of the pair of the second end panel portions 216*a* by a cutline.

The second handle reinforcing panel 280 is connected to the first handle reinforcing panel 282 by a hinged connection in the form of a fold line 281. Fold line 281 is collinear with fold line 215*b*.

The second handle reinforcing panel 280 is connected to the first one of the pair of the first end panel portions 212 at a first side edge of the second handle reinforcing panel 280 by a second bridging panel 284.

The second bridging panel 284 is disposed adjacent to the first side panel 214. A first side edge of the second bridging panel 284 is coupled to a first side edge of the second handle reinforcing panel 280 by a hinged connection in the form of a fold line 283. A second side edge of the second bridging panel 284 is coupled to a side edge of the first one of the pair of the first end panel portions 212 by a connecting portion 289*a*. The connecting portion 289*a* is sufficient to maintain the connection between the second bridging panel 284 and the first one of the pair of the first end panel portions 212 during handling of the blank 210 prior to assembly and optionally during at least a portion of the assembly process. The second bridging panel 286 is separated from first side panel 214 by a cutline.

The first and second handle reinforcing panels 282, 280 each comprises a handle reinforcing structure H1, H2 in the form of a handle opening. The handle opening may be formed at least in part by a handle aperture. Optionally, the handle opening may be formed at least in part by a cushioning flap struck from the respective one of the first and second handle reinforcing panels 282, 280 and hingedly connected thereto by a fold line. The cushioning flap may increase the comfort of the carrying handle when in use.

The handle openings of the handle reinforcing structure H1, H2 are arranged to be disposed in registry or alignment with the first handle opening of the first handle structure H.

The blank 210 comprises medial partition glue flap 228 hingedly connected to the first medial panel 222 along a second end (the second end opposes the first end, the first end is defined by fold line 221) by a hinged connection in the form of a fold line 229.

The blank 210 comprises a first partition structure P1 struck from the first medial panel 222. The first partition structure P1 defines a plurality of cells disposed between the first side panel 214 and the first medial panel 222. The first side panel 214 and the first medial panel 222 along with first portions of the first and second end panels 212, 216*a* define a tubular structure on a first side of the medial structure.

The first partition structure P1 comprises a first partition panel 250*a*, a second partition panel 254*a* and a first glue panel 252*a* struck from the first medial panel 222. The first and second partition panels 250*a*, 254*a* are each hingedly connected, at a first or proximal end, to the first medial panel 222 by a hinged connection in the form of a fold line, the respective fold lines define an inner ends of the first and second partition panels 250*a*, 254*a*.

The first and second partition panels 250*a*, 254*a* are dimensioned to extend between the first medial panel 222 and the first side panel 214 in a set up condition.

The first and second partition panels 250*a*, 254*a* are each coupled to the first glue panel 252*a*. The second partition panel 254*a* is hingedly connected, at a second or distal end, to a first end of the first glue panel 252*a* by a hinged connection in the form of fold line; the fold line defines an outer end of the second partition panel 254*a*.

The first partition panel 250*a* is coupled, at a second or distal end, to the first glue panel 252*a* by a twistable strip, formed in part from a distal end portion of the first partition panel 250*a* and in part from a second end portion of the first glue panel 252*a*. The twistable strip extends between, and joins with, the first partition panel 250*a* and the first glue panel 252*a*.

The twistable strip may form a single joint which connects between the distal end of the first partition panel 250*a* and the first glue panel 252*a*.

The twistable strip may be defined at least in part by an element 62 extending in at least one of the first partition panel 250*a* and the first glue panel 252*a*. The element may be a cutline or other cutaway as described above in relation to the first embodiment.

The blank 210 comprises a second partition structure P2 struck from the first medial panel 222. The first partition structure P1 defines a plurality of cells disposed between the second side panel 218 and the first medial panel 222. The second side panel 218 and the first medial panel 222 along with second portions of the first and second end panels 220, 216*b* define a tubular structure on a second side of the medial structure.

The second partition structure P2 comprises a third partition panel 250*b*, a fourth partition panel 254*b* and a second glue panel 252*b* struck from the first medial panel 222. The third and fourth partition panels 250*b*, 254*b* are each hingedly connected, at a first or proximal end, to the first medial panel 222 by a hinged connection in the form of a fold line, the respective fold lines define an inner ends of the third and fourth partition panels 250*b*, 254*b*.

The third and fourth partition panels 250*b*, 254*b* are dimensioned to extend between the first medial panel 222 and the second side panel 218 in a set up carrier.

The third and fourth partition panels 250*b*, 254*b* are each coupled to the second glue panel 252*b*. The fourth partition panel 254*b* is hingedly connected, at a second or distal end, to a first end of the second glue panel 252*b* by a hinged connection in the form of fold line; the fold line defines an outer end of the fourth partition panel 254*b*.

The third partition panel 250*b* is coupled, at a second or distal end, to the second glue panel 252*b* by a twistable strip, formed in part from a distal end portion of the first partition panel 250*b* and in part from a second end portion of the second glue panel 252*b*. The twistable strip extends between, and joins with, the first partition panel 250*b* and the second glue panel 252*b*.

The twistable strip may form a single joint which connects between the distal end of the first partition panel 250*b* and the second glue panel 252*b*.

The twistable strip may be defined at least in part by an element 62 extending in at least one of the first partition panel 250*b* and the second glue panel 252*b*. The element may be a cutline or other cutaway as described above in relation to the first embodiment.

The second partition structure P2 comprises a third glue panel 292 struck from the first medial panel 222. The fourth partition panel 254*b* is struck from within the third glue panel 292 and is hingedly connected thereto at the first or proximal end.

The third partition panel 250*b* is hingedly connected, at its first or proximal end, to at the third glue panel 292.

The third glue panel 292 is hingedly connected to the first medial panel 222 such that the second partition structure P2 is foldable with respect to first medial panel 222 about a hinged connection in the form of a fold line 293.

The second partition structure P2 is foldable to be arranged in face to face relationship with the first partition structure P1. In this way second partition structure P2 is disposed at substantially the same elevation above the composite base panel 226*a*/226*b*/226*c* as the first partition structure P1 in a set up carrier.

Turning to the construction of a carton from the blank of FIG. 9, the carton can be formed by a series of sequential folding operations in a straight-line machine so that the carton is not required to be rotated or inverted to complete its construction. The folding process is not limited to that described below and may be altered according to particular manufacturing requirements.

Glue or other adhesive treatment is applied to the third glue panel 292 or to a corresponding region of the first media panel 222.

The second partition structure P2 is folded, with respect to the first medial panel 222 about fold line 293. The second partition structure P2 brought into face contacting relationship with first partition structure P1.

Glue or other adhesive treatment is applied to the second glue panel 252*b*. Alternatively, glue or other adhesive treatment may be applied to a corresponding region of the second side panel 218.

Glue or other adhesive treatment is applied to an upper portion of the first medial panel 222. Alternatively, glue or other adhesive treatment may be applied to a corresponding region of the first handle reinforcing panel 282.

The second one of the first end panel portions 220 and the first medial panel 222 are folded together, with respect to the second side panel 218 about fold line 219. The first medial panel 222 is brought into face to face relationship with the second side panel 218 and the second one of the second end panel portions 216*b*. The medial partition glue flap 228 is brought into face to face relationship with the first one of the second end panel portions 216*a* is secured thereto in face contacting relationship therewith.

The second glue panel 252*b* is secured to the second side panel 218.

The first medial panel 222 is secured to the first handle reinforcing panel 282.

The first one of the first end panel portions 212, together with the riser panel 208, is folded about the fold line 213 to bring the first one of the first end panel portions 212 and the riser panel 208 into face to face relationship with the first side panel 214.

Glue or other adhesive treatment is applied to the first glue panel 252*a*. Alternatively, glue or other adhesive treatment may be applied to a corresponding region of the first side panel 214.

Glue or other adhesive treatment is applied to the riser panel 208. Alternatively, glue or other adhesive treatment may be applied to a corresponding region of the first medial panel 222.

Glue or other adhesive treatment is applied to the first medial panel 222. Alternatively, glue or other adhesive treatment may be applied to a corresponding region of the second handle reinforcing panel 280.

The first one of the second end panel portions 216*a*, together with the first side panel 214, first one of the first end panel portions 212, riser panel 208, first base panel 226*a* and base securing flap 226*c*, are folded about the fold line 215*b* to bring the first one of the second end panel portions 216*a* into face to face relationship with the second one of the second end panel portions 216*b* and the first side panel 214 in overlying relationship with the second side panel 218. The riser panel 208 is brought into face contacting relationship with the first medial panel 222.

The riser panel 208 is secured to the first medial panel 222.

The first glue panel 252*a* is secured to the first side panel 214.

The second handle reinforcing panel 280 is secured to the first medial panel 222.

In this way a flat collapsed tubular structure is formed. The flat collapsed carrier can be readily shipped or distributed in the flat condition to a plant for erecting and loading with primary product containers.

The flat collapsed carrier can be opened into a basket-style article carrier by separating the first and second side panels 214, 218 to form a tubular structure defined by the main panels 212, 214, 216*a*, 216*b*, 218, 220. The main panels 212, 214, 216*a*, 216*b*, 218, 220 define an interior chamber. The partition structures P1, P2 are automatically erected when the flat collapsed carrier is opened out or erected into the tubular form.

Once the carrier is erected, the first medial panels 222 forms a partition that is disposed medially within the interior of the carrier. The partition divides the interior of the carrier into two separate compartments on opposing sides of the first medial panel 222.

Referring now to FIGS. 10A, 10B, 11A, 11B, 12 and 13 there are shown exemplary alternative forms of the element 62. FIGS. 10A, 10B, 11A, 11B, 12 and 13 illustrate the first and second medial panels 322, 324; 422, 424; 522, 524; 622, 624; 722, 724; 822, 824. The remainder of the blanks 310; 410; 510; 610; 710; 810 is substantially the same as the blank 10 illustrated in FIG. 1 and/or as described above.

Figure 10B:
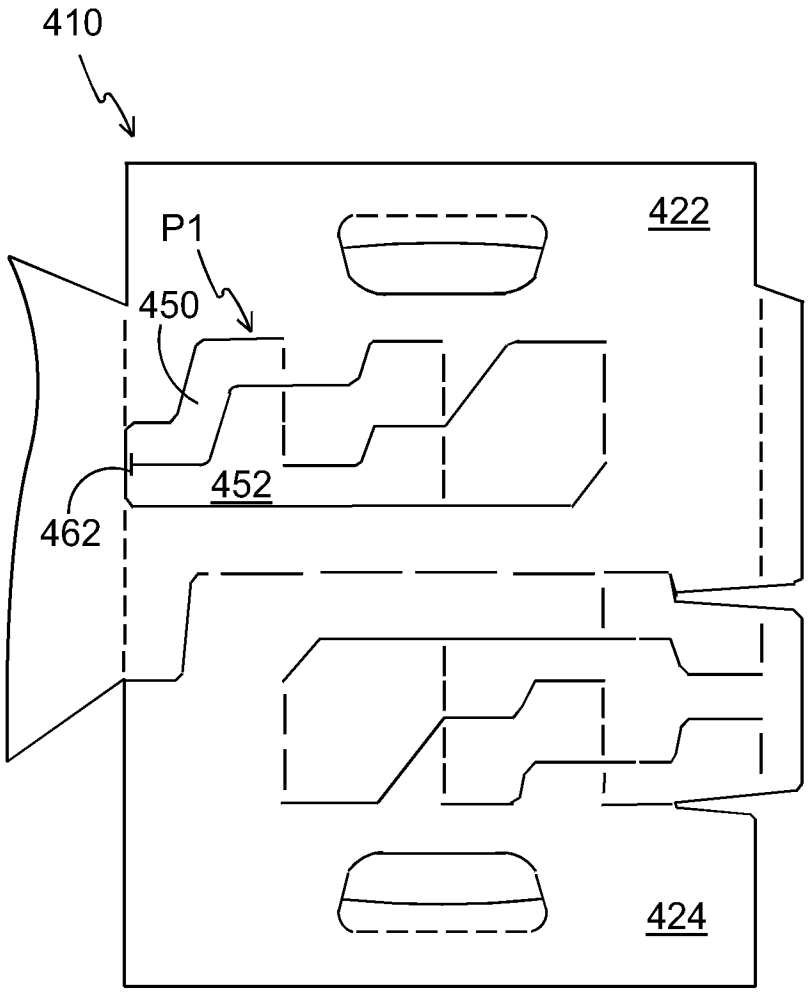
FIG. 10B is a plan view from above of a portion of a blank for forming a carrier according to a fifth embodiment.
Figure 10A:
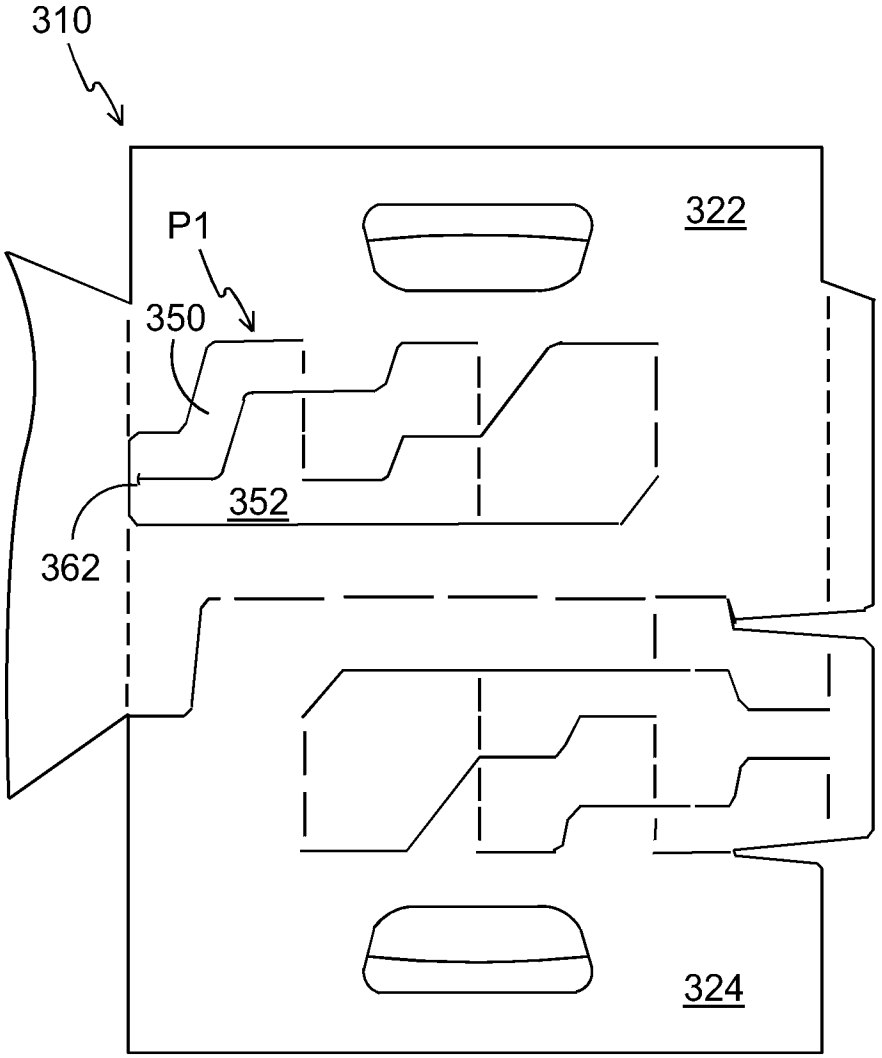
FIG. 10A is a plan view from above of a portion of a blank for forming a carrier according to a fourth embodiment.

In FIG. 10A the element 362 is curvilinear. An enlarged view of the element 362 is inset within FIG. 10A. The length of the element 362 has been reduced compared to the element 62 of FIG. 1A. Optionally or alternatively, the radius or curvature has been increased compared to the element 62 of FIG. 1A.

In FIG. 10B the element 462 is linear. The element 462 may be substantially perpendicular to the cut line 471. The element 462 may be substantially parallel to the end edge of the twistable strip and or parallel to the fold line 421 between the first medial panel 422 and the first inner end panel 420.

Figure 11B:
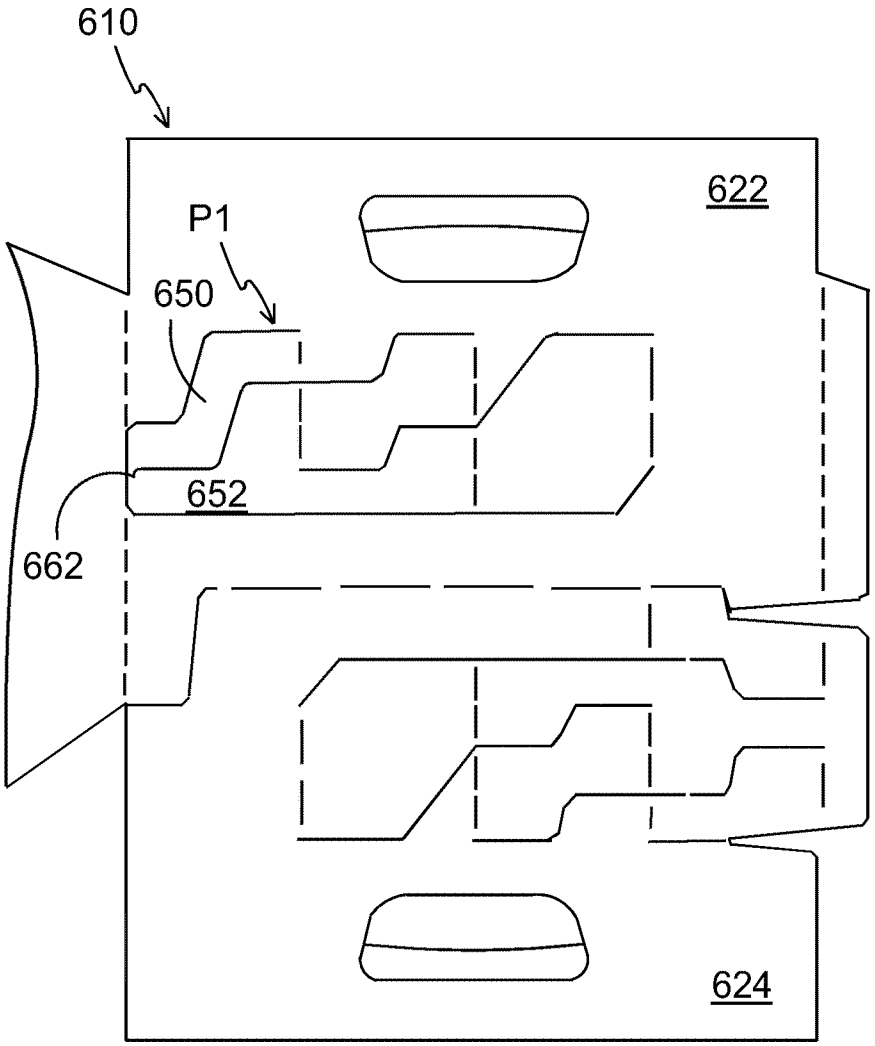
FIG. 11B is a plan view from above of a portion of a blank for forming a carrier according to a seventh embodiment.
Figure 11A:
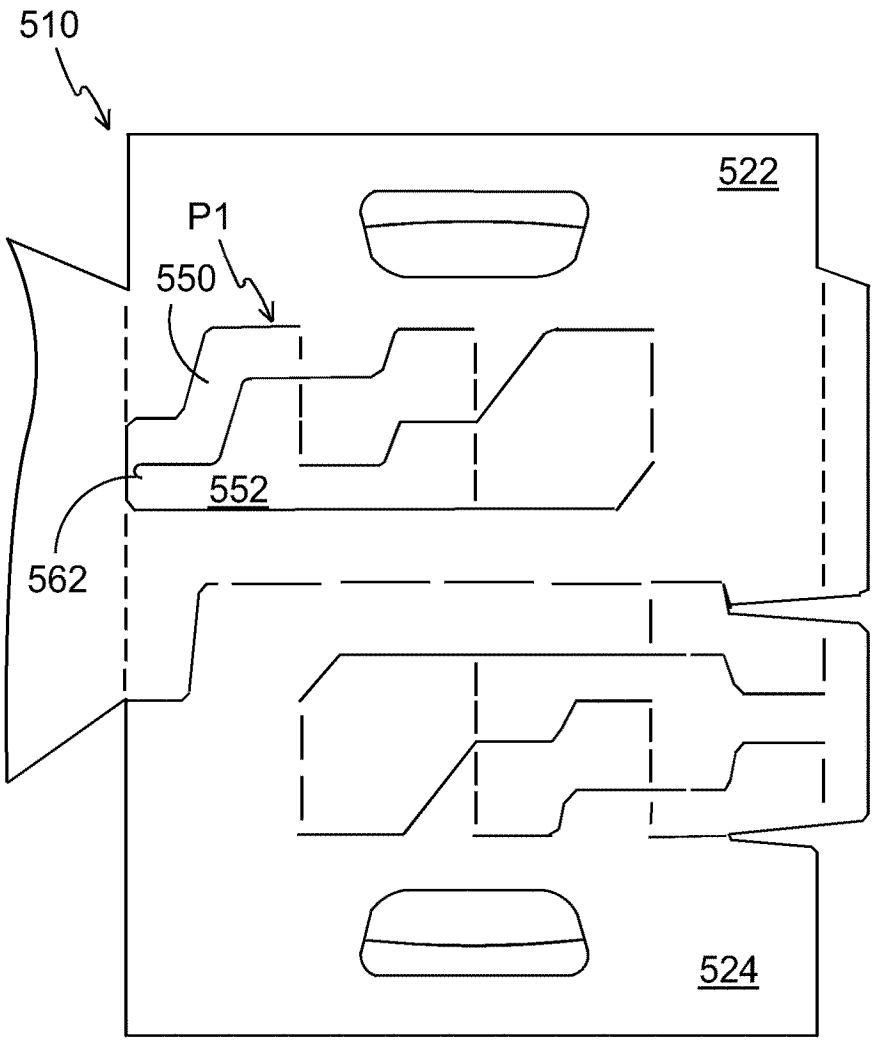
FIG. 11A is a plan view from above of a portion of a blank for forming a carrier according to a sixth embodiment.

In FIG. 11A the element 562 is curvilinear. The element 562 is arranged to be contiguous with the cutline 571, that is to say a terminal end of the cutline 571 is coincident with a terminal end of the curved cutline forming the element 562. The element 562 is struck from or defined solely in the glue panel 552.

In FIG. 11B the element 662 is curvilinear. The element 662 is arranged to be contiguous with the cutline 671, the length of the element 662 has been reduced compared to the element 562 of FIG. 11A. Optionally or alternatively, the radius or curvature has been increased compared to the element 562 of FIG. 11A. The element 662 is struck from or defined solely in the glue panel 652.

Figure 12:
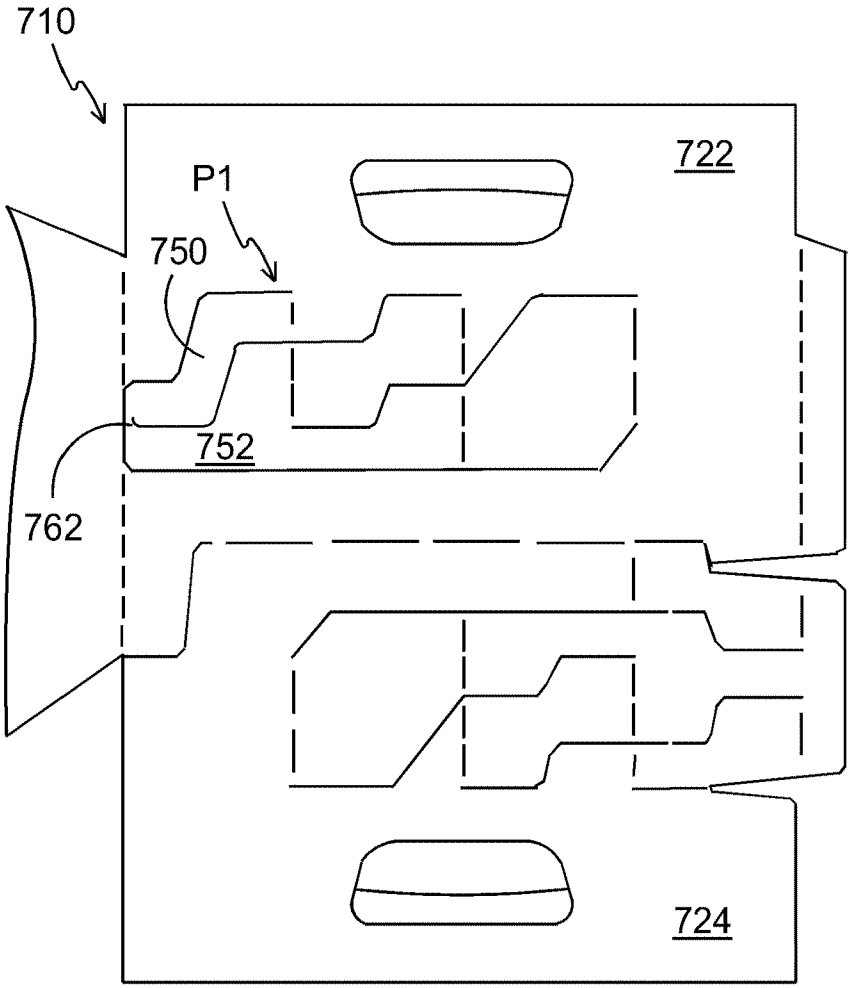
FIG. 12 is a plan view from above of a portion of a blank for forming a carrier according to an eighth embodiment.

In FIG. 12 the element 762 is curvilinear. The element 762 has been inverted compared the element 662 of FIG. 11B. The element 762 is arranged to be contiguous with the cutline 771, the length of the element 762 has been reduced compared to the element 562 of FIG. 11A. Optionally or alternatively, the radius or curvature has been increased compared to the element 562 of FIG. 11A. The element 762 is struck from or defined in the first partition panel 750 rather than in the glue panel 752.

Figure 13:
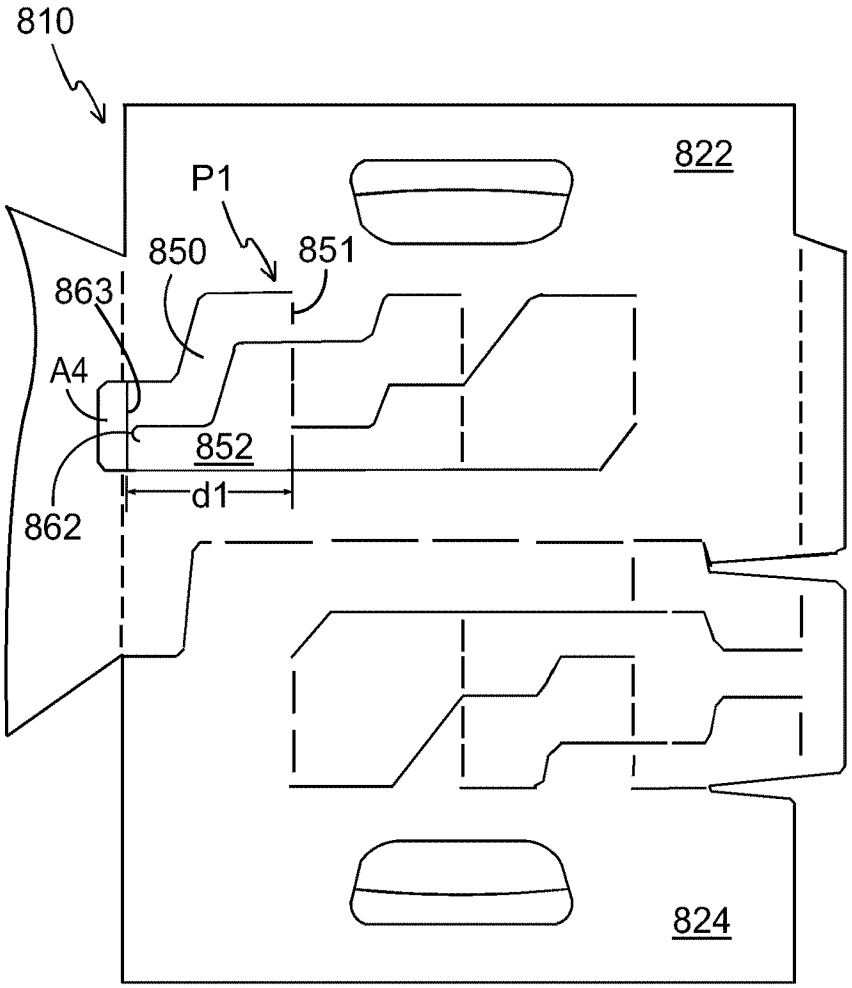
FIG. 13 is a plan view from above of a portion of a blank for forming a carrier according to a ninth embodiment.

In FIG. 13 the element 862 is curvilinear and arranged substantially as the element 562 illustrated in FIG. 11A and/or as described above. The end edge of in the first partition panel 850 and the glue panel 852 is offset with respect to the fold line 821 hinging the first medial panel 822 to the first inner end panel 820. The end edge of in the first partition panel 850 and the end edge of the glue panel 852 may be inset with respect to the fold line 821.

The first partition panel 850 has a length defined by a first distance, denoted by dimension arrow d1 in FIG. 13, the first distance d1 is defined by a linear dimension extending between a proximal end fold line 851 of the first partition panel 850 and a distal end edge 863 of the first partition panel 850. The first distance d1 is less than a second distance defined between the first medial panel 822 and the first side wall panel in a setup carrier.

Optionally, an aperture A4 is struck in part from the first medial panel 822 and in part from the first inner end panel 820. The aperture A4 interrupts the fold line 821 hinging the first medial panel 822 to the first inner end panel 820.

An advantage of the present disclosure is that the first partition structure comprises a reduced footprint for example when compared to the second partition structure P2 illustrated in FIG. 1, that is to say it occupies less area of the blank. The first partition structure may also comprise a reduced linear dimension, in the longitudinal direction. In this way the first partition structure may be struck from within the first medial panel.

The first partition structure may extend up to an edge of the first medial panel without extending beyond the edge of the first medial panel. In some embodiments this has the benefit that a panel adjacent to the first medial panel and hinged thereto is not interrupted or broken by the first partition structure, this may have structural benefits or aesthetic benefits or both.

Additionally or alternatively, this may be beneficial when constructing the blank into a carrier, in particular into the flat collapsed carrier, such as that illustrated in FIG. 7. Construction of the blank into the carrier may be more readily automated. The reduction in size of the first partition structure may reduce the likelihood of the blank colliding with, catching upon, or otherwise unintentionally engaging with a part of a packaging machine, thus avoiding or mitigating against the blank becoming entangled, trapped, misfed or misaligned during the assembly process.

It can be appreciated that various changes may be made within the scope of the present invention. For example, the size and shape of the panels and apertures may be adjusted to accommodate articles of differing size or shape. The present invention is not limited to cartons of the basket carrier style, the invention may be employed with other carton styles such as, but not limited to, open top crates, lidded or closed top crates and fully enclosed cartons.

In one embodiment the medial panel may omitted, the partition structure may be formed from a first one of a pair of opposing wall panels, the opposing wall panels defining in part an interior of the carrier. The partition structure may divide the interior into two or more article receiving cells.

The partition structure may comprise a lateral partition panels hingedly connected at a proximal end to said first one of the pair of opposing wall panels by proximal end fold line and at its distal end to a glue panel by a distal end joint. The distal end joint between the lateral partition panel and the glue panel comprises a twistable strip extending between and joined with the lateral partition panel and the glue panel. The lateral partition panel may have a length defined by a first distance defined between the proximal end fold line of the lateral partition panel and a distal end edge of the first lateral partition panel. The first distance may generally equal to or less than a second distance defined between the first panel the second panel.

It will be recognised that as used herein, directional references such as “top”, “bottom”, “base”, “front”, “back”, “end”, “side”, “inner”, “outer”, “upper” and “lower” do not necessarily limit the respective panels to such orientation, but may merely serve to distinguish these panels from one another.

As used herein, the terms “hinged connection” and “fold line” refer to all manner of lines that define hinge features of the blank, facilitate folding portions of the blank with respect to one another, or otherwise indicate optimal panel folding locations for the blank. Any reference to “hinged connection” should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line or a severance line or both. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier comprising a plurality of primary panels for forming a tubular structure and defining an interior of the article carrier, the plurality of primary panels including:

a first panel; and a second panel opposing the first panel;

wherein the carrier further comprises a partition structure for dividing the interior into two or more article-receiving cells, the partition structure being formed from the first panel and comprising a lateral partition panel hingedly connected at a proximal end to the first panel by a proximal end fold line and hingedly connected at a distal end to a glue panel by a distal end joint;

wherein the distal end joint between the lateral partition panel and the glue panel comprises a twistable strip extending between and joined with the lateral partition panel and the glue panel;

wherein the lateral partition panel has a length defined by a first distance extending between the proximal end fold line of the lateral partition panel and a distal end edge of the lateral partition panel;

wherein the first distance is generally equal to or less than a second distance extending between the first panel and the second panel; and wherein the twistable strip is defined at least in part by one or more of: (i) a curved element extending into both the lateral partition panel and the glue panel, (ii) a cutaway element provided in at least one of the lateral partition panel and the glue panel, and (iii) a tear stopper disposed in at least one of the lateral partition panel and the glue panel.

2. The article carrier of claim 1 wherein the partition structure comprises a pair of lateral partition panels hingedly connected at their respective proximal ends to the first panel by proximal end fold lines and at their respective distal ends to a common glue panel by distal end joints, wherein the distal end joint between a first one of the pair of lateral partition panels and the glue panel comprises the twistable strip.

3. The article carrier of claim 1 wherein the tubular structure is collapsible.

4. The article carrier of claim 3 wherein the partition structure automatically erected when the tubular structure is erected from a collapsed condition.

5. The article carrier of claim 1 wherein the tubular structure comprises an end closed at least in part by one or more bottom panels.

6. The article carrier of claim 1 wherein the glue panel includes a glue-free region along an end edge thereof and continuous with the distal end edge of the first lateral partition panel, the glue-free region extending along the distal end edge into the first lateral partition panel.

7. An article carrier comprising a plurality of primary panels for defining an interior of the article carrier, the plurality of primary panels including a first panel and an opposing second panel for forming a part of a collapsible tubular structure, the tubular structure having an end closed at least in part by one or more bottom panels, wherein the article carrier further comprises a partition structure formed from the first panel for dividing the interior into two or more article-receiving cells, the partition structure comprising first and second lateral partition panels hingedly connected at their respective proximal ends to the first panel by proximal end fold lines and at their respective distal ends to a common glue panel by distal end joints, wherein the distal end joint between the first lateral partition panel and the glue panel comprises a twistable strip extending between and joined with the first lateral partition panel and the glue panel wherein the first lateral partition panel has a length defined by a first distance between the proximal end fold line of the first lateral partition panel and a distal end edge of the first lateral partition panel and wherein the first distance is generally equal to or less than a second distance between the first panel and the second panel, and wherein the glue panel includes a glue-free region along an end edge thereof and continuous with the distal end edge of the first lateral partition panel, the glue-free region extending along at least a portion of the distal end edge into the first lateral partition panel.

8. The article carrier of claim 7 wherein the twistable strip is a single joint which connects between the distal end of the first lateral partition panel and the glue panel.

9. The article carrier of claim 7 wherein the twistable strip is defined at least in part by a cutaway element provided n at least one of the first lateral partition panel and the glue panel.

10. The article carrier of claim 7 wherein the twistable strip is defined at least in part by a tear stopper disposed in at least one of the first lateral partition panel and the glue panel.

11. The article carrier of claim 10 wherein the tear stopper comprises a curved element extending in at least one of the first lateral partition panel and the glue panel, the curved element has at least one terminal end which is spaced apart from an adjacent one of the end edge and the distal end edge, a third distance defined between the at least one terminal end and the adjacent one of the end edge and the distal end edge being equal to or greater than a distance between the adjacent one of the end edge and the distal end edge and another part of the curved element.

12. The article carrier of claim 10 wherein the tear stopper comprises a curved element extending in at least one of the first lateral partition panel and the glue panel, the curved element has at least one terminal end which is directed away from the adjacent one of the end edge and the distal end edge.

13. The article carrier of claim 11 wherein the first lateral partition panel and the glue panel are separated from each other along a cut line when the carrier is in a blank form, the cut line extending between the proximal end fold line and the curved element and wherein the curved element comprises one selected from the group consisting of a C-shaped cut, a J-shaped cut, an oval slot and an aperture.

14. The article carrier of claim 6 wherein the twistable strip is defined at least in part by a curved element extending into both the first lateral partition panel and the glue panel.

15. The article carrier of claim 7 wherein the first lateral partition panel and the glue panel are separated from each other along a cut line and wherein the glue-free region includes at least an area defined between the end edge and the distal end edge and a notional line passing through the cut line, the notional line extending alongside the end edge and the distal end edge.

16. The article carrier of claim 12 wherein the glue-free region includes at least an area defined between one of the end edge and the distal end edge and a notional line passing through the at least one terminal end, the notional line extending alongside the one of the end edge and the distal end edge.

17. The article carrier of claim 12 wherein the twistable strip has a maximum width extending between the at least one terminal end and the adjacent one of the end edge and the distal end edge.

18. The article carrier of claim 7 wherein the twistable strip is disposed at an elevation vertically offset from the distal end fold line.

19. The article carrier of claim 18 wherein the elevation of the twistable strip is below the lower end of the distal end fold line or above the upper end of the distal end fold line.

20. The article carrier of claim 7 wherein the first lateral partition panel comprises a proximal portion connected to the first panel, an intermediate portion joined to the proximal portion and a distal portion joined to the intermediate portion and wherein the proximal and distal portions are disposed at their respective elevations vertically offset from each other.

21. The article carrier of claim 7 wherein the twistable strip is defined at least in part by a cutaway element provided in the glue-free region of at least one of the first lateral partition panel and the glue panel.

22. The article carrier of claim 9 wherein the cutaway element comprises one selected from the group consisting of a linear cutline, a non-linear cutline, a frangible line, a slit, a slot, a C-shaped cut, a J-shaped cut, an oval slot and an aperture.

23. A blank for forming an article carrier, the blank comprising a plurality of primary panels for forming walls of a tubular structure defining an interior chamber, the plurality of primary panels including:

a first panel; and a second panel opposing the first panel;

wherein the blank further comprises a partition structure for dividing the interior chamber into two or more article-receiving cells, the partition structure being formed from the first panel and comprising a lateral partition panel hingedly connected at a proximal end to the first panel by a proximal end fold line and hingedly connected at a distal end to a glue panel by a distal end joint;

wherein the distal end joint between the lateral partition panel and the glue panel comprises a twistable strip extending between and joined with the lateral partition panel and the glue panel;

wherein the lateral partition panel has a length defined by a first distance extending between the proximal end fold line of the lateral partition panel and a distal end edge of the lateral partition panel;

wherein the distance is arranged to be generally equal to or less than a second distance extending between the first panel and the second panel when the blank is erected to form a tubular structure; and wherein the glue panel includes a glue-free region along an end edge thereof and continuous with the distal end edge of the lateral partition panel, the glue-free region extending along at least a portion of the distal end edge into the first lateral partition panel.

* * * * *